US006005468A

United States Patent [19]

Shirahata et al.

[11] Patent Number: 6,005,468

[45] Date of Patent: Dec. 21, 1999

[54] AMORPHOUS TRANSFORMER

[75] Inventors: Toshiki Shirahata; Masayuki Horiuchi, both of Nakajo-machi; Katsutoshi Inagaki, Niigata; Takayuki Yamazaki, Niigata-ken; Koji Yamanaka, Toyosaka, all of Japan

[73] Assignee: Hitachi, Ltd., Tokyo, Japan

[21] Appl. No.: 09/090,930

[22] Filed: Jun. 5, 1998

[30] Foreign Application Priority Data

| | | | |
|---|---|---|---|
| Jun. 6, 1997 | [JP] | Japan | 9-149331 |
| Jun. 6, 1997 | [JP] | Japan | 9-149332 |
| Sep. 19, 1997 | [JP] | Japan | 9-254494 |

[51] Int. Cl.[6] ..... H01F 27/24

[52] U.S. Cl. ..... 336/212; 336/210; 336/213; 336/216; 336/234

[58] Field of Search ..... 336/210, 212, 336/213, 216, 217, 234; 29/609

[56] References Cited

U.S. PATENT DOCUMENTS

| | | | |
|---|---|---|---|
| 3,128,443 | 4/1964 | Etal | 336/212 |
| 4,520,335 | 5/1985 | Rauch et al. | 336/212 |
| 4,648,929 | 3/1987 | Siman | 156/188 |
| 4,663,605 | 5/1987 | Lee | 336/197 |
| 4,734,975 | 4/1988 | Ballard et al. | 29/606 |
| 4,893,400 | 1/1990 | Chenoweth | 29/606 |

FOREIGN PATENT DOCUMENTS

| | | |
|---|---|---|
| 63-193512 | 8/1988 | Japan . |
| 08-31667 | 2/1996 | Japan . |
| 8-31667 | 2/1996 | Japan . |

*Primary Examiner*—Michael L. Gellner
*Assistant Examiner*—Tuyen T. Nguyen
*Attorney, Agent, or Firm*—Beall Law Offices

[57] ABSTRACT

An amorphous transformer prevents deformation or deflection caused by the repulsion force between an outer coil and an inner coil and prevents formation of a one-turn-current through a reinforcement member and a coil frame. The amorphous transformer includes amorphous cores, an outer coil and an inner coil, a coil frame and a reinforcement member. The reinforcement member prevents the amorphous core from being deformed inward by the electromagnetic force of the coil, and the frame member and the reinforcement member prevents formation of an electrical closed-loop. Accordingly, the amorphous transformer core is protected from being damaged.

11 Claims, 22 Drawing Sheets

FIG. 17 (b)
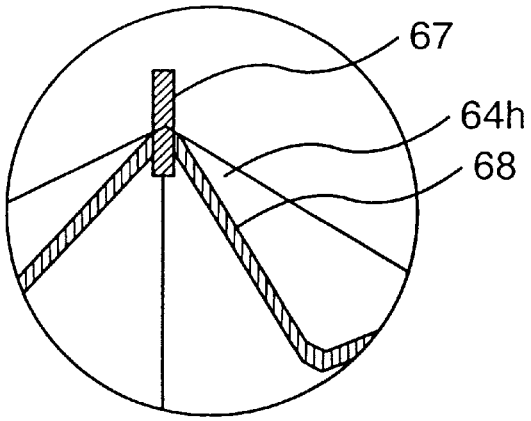
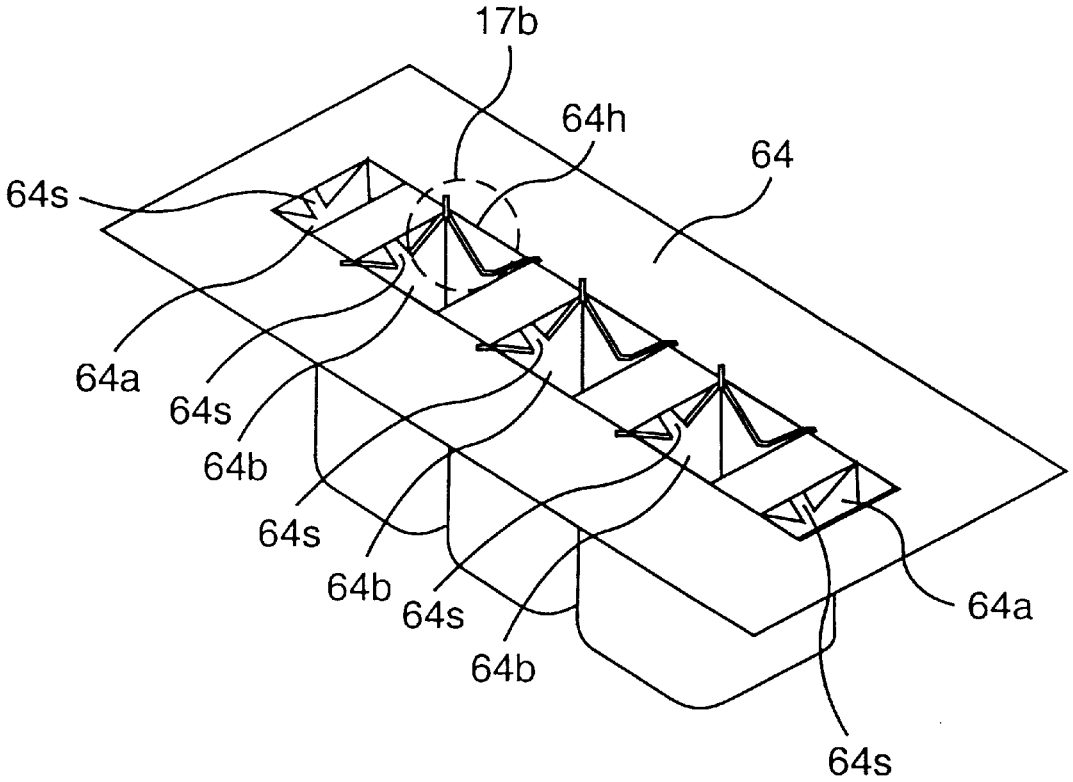
FIG. 17 (a)

FIG. 18 (b)
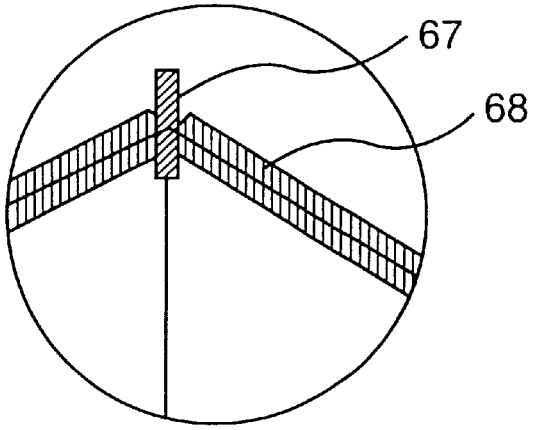
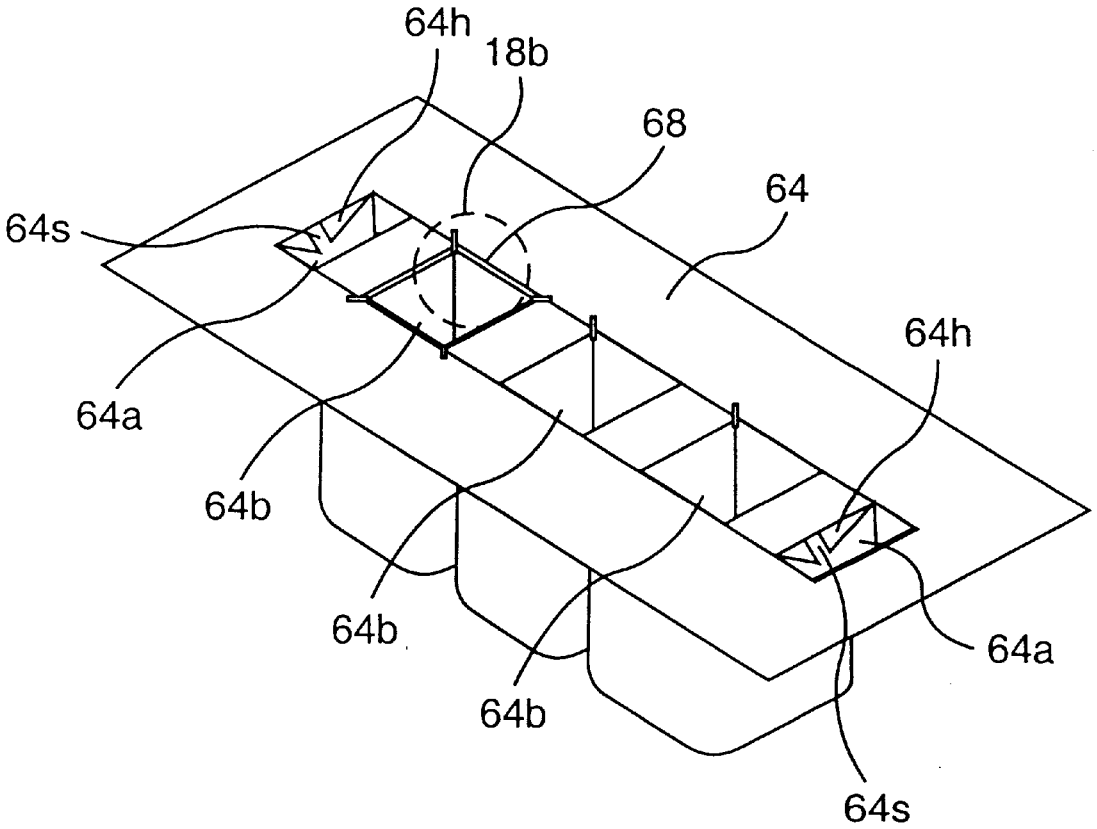
FIG. 18 (a)

AMORPHOUS TRANSFORMER

BACKGROUND OF THE INVENTION

1. Technical Field of the Invention

This invention relates to an amorphous transformer with a wound laminated core, and particularly to an amorphous transformer suitable for protecting the core from being damaged and for preventing fragments of amorphous metal from being scattered within coolant oil used to cool the transformer.

2. Description of Prior Art

A transformer has a core or cores forming a magnetic circuit and a coil or coils forming an electric circuit, for converting high voltage/small current alternating current (hereinafter AC) power into low voltage/large current AC power, or vice versa. As for the material of the core, some transformers have cores of amorphous ferromagnetic materials instead of oriented silicon steel. As for the construction of the amorphous metal core, wound laminated cores are used more often than stacked cores.

An example of an amorphous core transformer of the prior art with a wound laminated core is shown in FIGS. 21–24.

A basic construction of the amorphous transformer in the prior art is disclosed in FIGS. 21–23. In this prior art, the amorphous core transformer has a wound laminated core 1 of amorphous metal and a pair of coils 2, as disclosed in FIG. 22, only one of which is discussed in detail. The coil has an opening for inserting a leg portion of the wound laminated core 1. A coil frame 24 for winding the coil 2 thereon is disposed in the opening of the coil 2. As disclosed in FIG. 21, an amorphous sheet has a narrower width than that of a silicon steel sheet. However, in order to obtain a wider sectional area of the core 1 for use in large capacity transformers, two amorphous cores 11*a* and 11*b* are disposed side by side within the coil frame 24 as disclosed in FIG. 23. In such a construction, the longer side of the coil frame 24 is likely to be deflected by a force perpendicular to this side. When a large current such as a short-circuit current flows through the coil 2, an electro-magnetic repulsion force is generated between the inner winding 22 and the outer winding 21, between which is an insulation layer 23. The inner winding 22 is forced to move inward, which also forces the coil frame 24 to move inward and cause deflection as shown in FIG. 24. This deflection is transmitted to the amorphous cores 11*a* and 11*b* via spacers 3, which causes mechanical stress in the cores 11*a*, 11*b*.

In order to prevent the cores from being stressed as disclosed in prior art Japanese patent laid-open publication no. 63-193512 a construction using FRP plates or a plurality of laminated silicon steel plate are used as a reinforcement member disposed in such a manner that both ends thereof are abutted to the inner surface of a coil frame made of an insulating material. In general, insulating materials including FRP cause aged deterioration. In most cases, a decrease of volume occurs as aged deterioration occurs. When the volume of the coil frame decreases, a coil wound thereon becomes loosened and such undesirable phenomena as vibration or noise are likely to occur.

SUMMARY OF THE INVENTION

The object of the present invention is to provide an amorphous transformer having a construction capable of avoiding the stress caused from deformation or deflection of the inner coil corresponding to an electro-magnetic repulsion force due to such a huge current as that of a short-circuit current.

Another object of the present invention is to provide an amorphous transformer having a construction capable of preventing such undesirable phenomena as vibration or noise from occurring due to a loosening of the coil caused by a reduction in the volume of the coil frame due to aged deterioration of the insulation material of the coil frame.

A further object of the present invention is to prevent a closed-loop circuit for one-turn-current (eddy current) from being formed within the coil frame and the reinforcement member when a metal coil frame and a metal reinforcement member are employed.

In order to provide the above and other objects and advantages, the present invention provides an amorphous transformer comprising a first amorphous core including a plurality of wound layers of amorphous sheets, a second amorphous core including a plurality of wound layers of amorphous sheets and juxtaposed to the first amorphous core and a reinforcement member disposed between the first amorphous core and the second amorphous core. The transformer has a coil formed of a plurality of layers of electric conductors that has an opening for inserting the first amorphous core and the second amorphous core. Also included, according to a preferred embodiment of the invention, is a frame member disposed along an inside of the opening for winding the conductors thereon, wherein the reinforcement member is disposed in such a manner that prevents the first amorphous core and the second amorphous core from being deformed inward by electromagnetic force from the coil. Further, the frame member and the reinforcement member are disposed in such a manner than formation of an electrical closed-loop is prevented.

In another embodiment, the present invention provides an amorphous transformer comprising a first amorphous core including a plurality of wound layers of amorphous sheets, a second amorphous core including a plurality of wound layers of amorphous sheets and juxtaposed to the first amorphous core and a reinforcement member disposed between the first amorphous core and the second amorphous core. The transformer has a coil formed of a plurality of layers of electric conductors that has an opening for inserting the first amorphous core and the second amorphous core. A frame member disposed along an inside of the opening is provided for winding the conductors thereon, wherein the reinforcement member is disposed in such a manner that prevents the first amorphous core and the second amorphous core from being deformed inward by electromagnetic force from the coil. Also, a frame member and the reinforcement member are disposed in such a manner that formation of an electrical closed-loop is prevented. Preferably, the reinforcement member is a silica-steel core including a plurality of wound layers of silica-steel metal sheets, and preferably the silica-steel core has a thickness not less than that of the first amorphous core and the second amorphous core.

In a third embodiment, the present invention provides an amorphous transformer comprising a first amorphous core including a plurality of wound layers of amorphous sheets, a second amorphous core including a plurality of wound layers of amorphous sheets and juxtaposed to the first amorphous core and a reinforcement member disposed between the first amorphous core and the second amorphous core. The transformer has a coil formed of a plurality of layers of electric conductors that has an opening for inserting the first amorphous core and the second amorphous core A frame member disposed along an inside of the opening for winding the conductors thereon is provided, wherein the reinforcement member is disposed in such a manner that prevents the first amorphous core and the second amorphous core from being deformed inward by electromagnetic force from the coil. Also, the frame member and the reinforcement member are disposed in such a manner that formation of an electrical closed-loop is prevented, the frame member is disposed so as to enclose each of the first amorphous core and the second amorphous core, and the reinforcement member is a juxtaposed portion of the frame member.

In a fourth embodiment, the present invention is an amorphous transformer comprising a first amorphous core including a plurality of wound layers of amorphous sheets and having a pair of yoke portions and a first joint portion for opening the first amorphous core at one of the yoke portions, a second amorphous core including a plurality of wound layers of amorphous sheets and juxtaposed to the first amorphous core and having a pair of yoke portions and a second joint portion for opening the second amorphous core at one of the yoke portions. The transformer has a coil formed of a plurality of layers of electric conductors that has an opening for inserting the first amorphous core and the second amorphous core, a reinforcement member disposed between the first amorphous core and the second amorphous core in such a manner that prevents the first amorphous core and the second amorphous core from being deformed inward by electromagnetic force from the coil. Further, a frame member is disposed along an inside of the opening for winding the conductors thereon and a cover member is provided for covering a surface of the first amorphous core and the second amorphous core except for the first joint portion and the second joint portion. Still further, a wrapping member having an opening corresponding to the opening of the coil for wrapping the yoke portion of the first amorphous core and the second amorphous core is provided according to this embodiment.

BRIEF DESCRIPTION OF THE DRAWINGS

FIG. 13(*b*) is a perspective view of a silicon steel core reinforcement member having an open joint portion.

FIG. 17(*a*) is a perspective view of a cover member used in the third or the fourth embodiment of the present invention.

FIG. 17(*b*) is an enlarged partial view of the encircled portion 17*b* shown in FIG. 17(*a*).

FIG. 18(*a*) is a perspective view of a variation of the cover member according to the third or the fourth embodiment of the present invention.

FIG. 18(*b*) is an enlarged partial view of the encircled portion 18*b* shown in FIG. 18(*a*).

DETAILED DESCRIPTION OF THE PREFERRED EMBODIMENTS

The preferred embodiments of the present invention will now be described with reference to FIGS. 1 to 20.

The first embodiment of an amorphous core transformer of the present invention is described with reference to FIGS. 1, 2 and 13(*a*) or 15. In this embodiment, the transformer is a single-phase transformer having a wound laminated core 1 of amorphous metal and a pair of coils 2, only one of which is discussed in detail.

In general, commercially available amorphous sheets have a narrower width than that of oriented silicon steel sheets. In order to use an amorphous sheets for a large capacity transformer, therefore, a plurality of amorphous cores are combined side by side so as to obtain the large cross-section required for the capacity.

Figure 1:
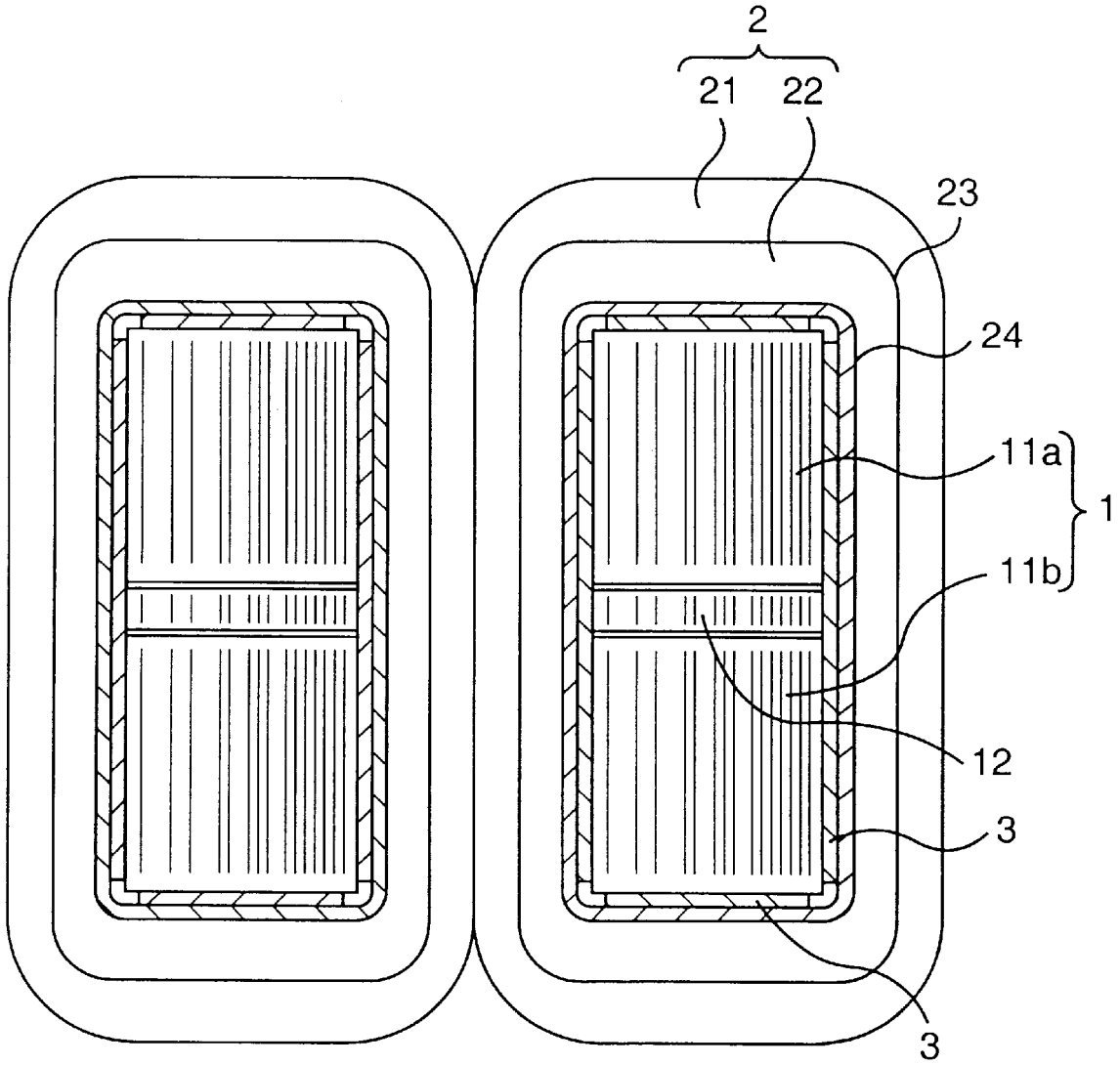
FIG. 1 is a horizontal cross-sectional view of an amorphous transformer according to a first embodiment of the present invention.

As shown in FIG. 1, the amorphous wound laminated core 1 has a first amorphous core 11*a* and a second amorphous core 11*b*. A silicon steel core 12 is disposed between the first amorphous core 11*a* and the second amorphous core 11*b* as a reinforcement member. Each of the first amorphous core 11*a* and the second amorphous core 11*b* includes a plurality of wound layers of amorphous sheets so as to form an amorphous wound laminated core. The silicon steel core 12 includes a plurality of wound layers of oriented silicon steel sheets so as to form a silicon steel wound laminated core.

The width of the oriented silicon steel sheets is much narrower than that of the amorphous sheets. Each amorphous sheet in the first amorphous core 11*a* and the second amorphous core 11*b* and each oriented silicon steel sheet in the silicon steel core 12 is cut at predetermined lengths respectively. The cut lengths of these sheets are laminated on a rectangular mandrel (not shown in the drawings) to form a rectangular core.

In order to form a rectangular amorphous core, a manufacturing method such as that disclosed in U.S. Pat. No. 5,261,152 is employed. Each of the amorphous cores 11*a*, 11*b* has a pair of yoke portions 11*c*, 11*d* and a pair of leg portions 11*e*, 11*f*, respectively (FIGS. 13(*a*) and 15). A first joint portion 30*a* is disposed in the yoke portion 11*d* at the side of the leg portion lie and a second joint portion 30*b* is disposed in the yoke portions 11*d* at the side of the leg portion 11*f*. Similarly, as shown in FIG. 13(*b*), the silicon steel core 12 has a pair of yoke portions 12*a*, 12*b* and a pair of leg portions 12*c*, 12*d* and has a similar shape to that of the amorphous cores 11*a*, 11*b*, although not as wide, as shown in FIG. 1, for example. The silicon steel core 12 also has a joint portion 30*c*, 30*d* in the yoke portions 12*b* as do the amorphous cores 11*a*, 11*b*.

Figure 13:
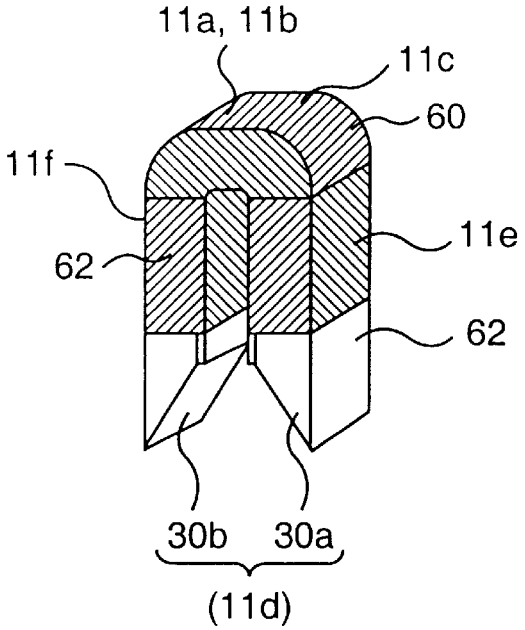
FIG. 13(*a*) is a perspective view of an amorphous core having a cover member and with a joint portion opened according to the third embodiment of the present invention.
Figure 13:
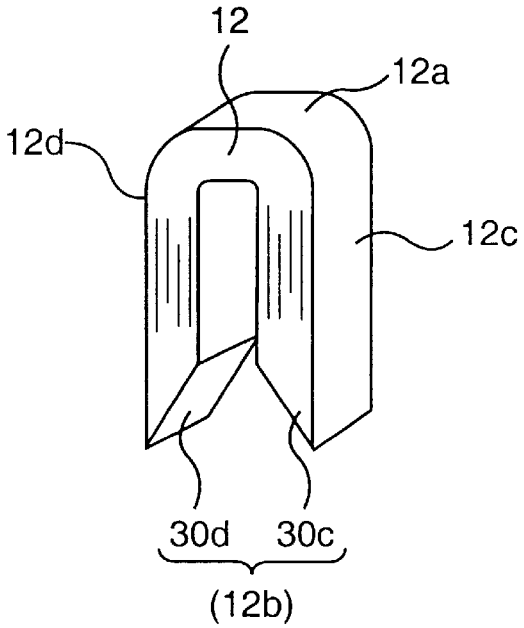

Each of the rectangular cores 11*a*, 11*b* and 12 are capable of having open joint portions as shown in FIG. 13(*a*) or 15 and FIG. 13(*b*), respectively. These joint portions 30*a*, 30*b*, 30*c* and 30*d* are arranged to be placed on the same side, during assembly, and are opened together when the legs 11*e*, 11*f* and 12*c*, 12*d* are inserted into the coil frame 24. After the insertion of the legs 11*e*, 11*f* and 12*c*, 12*d* into the coil frame 24, the joint portions 30*a*, 30*b* and 30*c*, 30*d* are closed again.

In this embodiment, a butted joint is formed, i.e. both ends of each amorphous sheet or each silicon steel sheet are disposed so as to face each other, separated by a short distance including zero (no separation between the ends or only by a distance within several mm). The amorphous cores 11*a*, 11*b* are easily deformed by an external force or even by their own weight, since they are made of a material that is not so rigid as that of the silicon steel core 12.

As mentioned, the silicon steel core 12 is used as a reinforcement member to prevent the amorphous cores 11*a* and 11*b* from being deformed. As shown in FIG. 1, after the insertion of the cores, the first amorphous core 11*a* and the second amorphous core 11*b* are juxtaposed edgewise with each other, and the silicon steel core 12 is disposed also edgewise between the first amorphous core 11*a* and the second amorphous core 11*b*.

In this embodiment, the coil 2 has an inner winding 22 and an outer winding 21, and they are arranged in such a manner that a direction of current in the inner winding 22 is opposite to that of the outer winding 21. A main insulation layer 23 is disposed between the inner winding 22 and the outer winding 21 so as to electrically insulate both windings. The inner winding 22 is wound on a rectangular coil frame 24 or frame member in such a manner that the coil frame 24 is disposed at the innermost portion of the coil 2.

When the coil frame 24 is made of an insulating material such as FRP (Fiber-Reinforced Plastic), epoxy resin or phenolic resin, for example, it can have a square or rectangular cross-section. When the coil frame 24 is made of low magnetic permeance steel plate, e.g. such as stainless steel (SUS 304), having electrical conductivity, it can have a C-shaped cross-section so as to form a slit 24*g* (FIGS. 4–7) for preventing a one-turn-current from flowing inside. Both ends of the C-shaped cross-section are connected with electrical insulating member 23*g*. Materials such as epoxy resin, wood, press-board or cardboard can be used for the electrical insulating member 23. Spacers 3 are inserted, not only for adjustment of the size but also for electrical insulation from the coil 2, between the coil frame 24 and the amorphous cores 11*a*, 11*b*. The spacers 3 are also disposed between the coil frame 24 and the silicon steel core 12 for the same purpose. The spacer 3 is generally made of such electrical insulation material as press-board or FRP.

Figure 24:
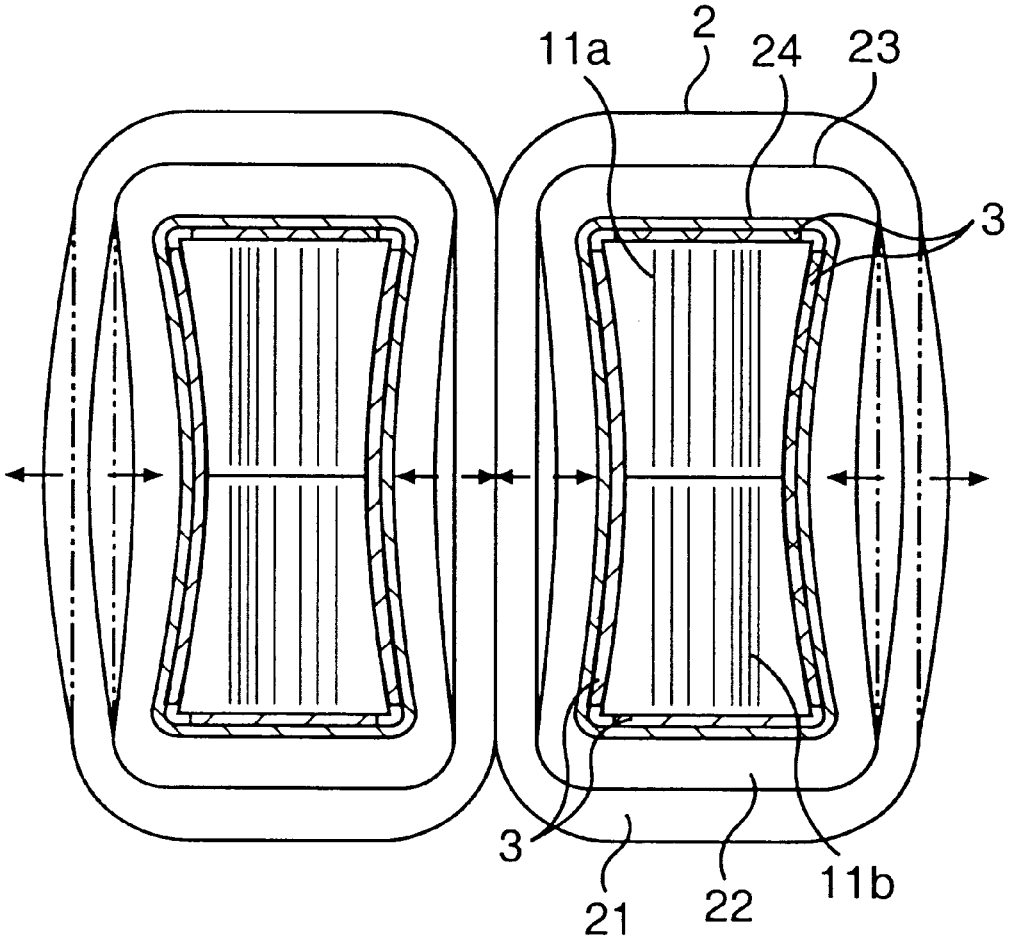
FIG. 24 (PRIOR ART)
FIG. 24 is a horizontal cross-sectional view of the prior art amorphous transformer shown in FIG. 23 showing deflection of a coil frame by an electromagnetic force generated by the coil.

In such a construction and with reference to FIG. 24, the longer side of the coil frame 24 is likely to be deflected by a force perpendicular to this side. When a large current such as a short-circuit current flows through the coil 2, an electromagnetic repulsion force is generated between the inner winding 22 and the outer winding 21. The inner winding 22 is forced to move inward, which also forces the coil frame 24 to move inward and cause deflection as shown in FIG. 24. This deflection is transmitted to the amorphous cores 11*a* and 11*b* via spacers 3, which causes mechanical stress in the cores 11*a*, 11*b*.

In general, it is known that magnetic characteristics deteriorate when mechanical stress is applied to the amorphous cores. In order to prevent the amorphous cores 11*a*, 11*b* from receiving stress, according to the present invention, the silicon steel core 12 has a thickness not less than that of the amorphous cores 11*a*, 11*b* and is disposed where the deflection is likely to occur, e.g., at the mid portion of the longer side of the coil 2. This construction protects the amorphous cores 11*a*, 11*b* from the mechanical stress, since the silicon steel core 12 having more rigidness than that of the amorphous cores 11*a*, 11*b* withstands the mechanical stress, which in turn reduces the deterioration of the magnetic characteristics of the amorphous cores 11*a*, 11*b*.

In this embodiment, a silicon steel core 12 is used as the reinforcement member. However, the reinforcement member is not restricted to this construction. For instance, a lamination of flat silicon steel sheets can be used as the reinforcement member. In this case, the silicon steel sheets are laminated perpendicular to the lamination of the amorphous core, in other words, the silicon steel sheets are laminated edgewise against or perpendicular to the deflection of coil frame 24. As for the steel sheets, not only just square or rectangular sheets, but also E-shaped sheets, can be used. Since every sheet in the lamination is disposed perpendicular to the direction of stress, the strength of the reinforcement member can be improved. In addition, the magnetic characteristics can be arranged by varying the numbers of sheets in the lamination. In this case, the formation of a closed loop for an eddy current is prevented since the spacers 3 are made of an electrical insulating material and are disposed between the respective ends of the reinforcement member 12 and the inner surface of the coil frame 24.

Figure 2:
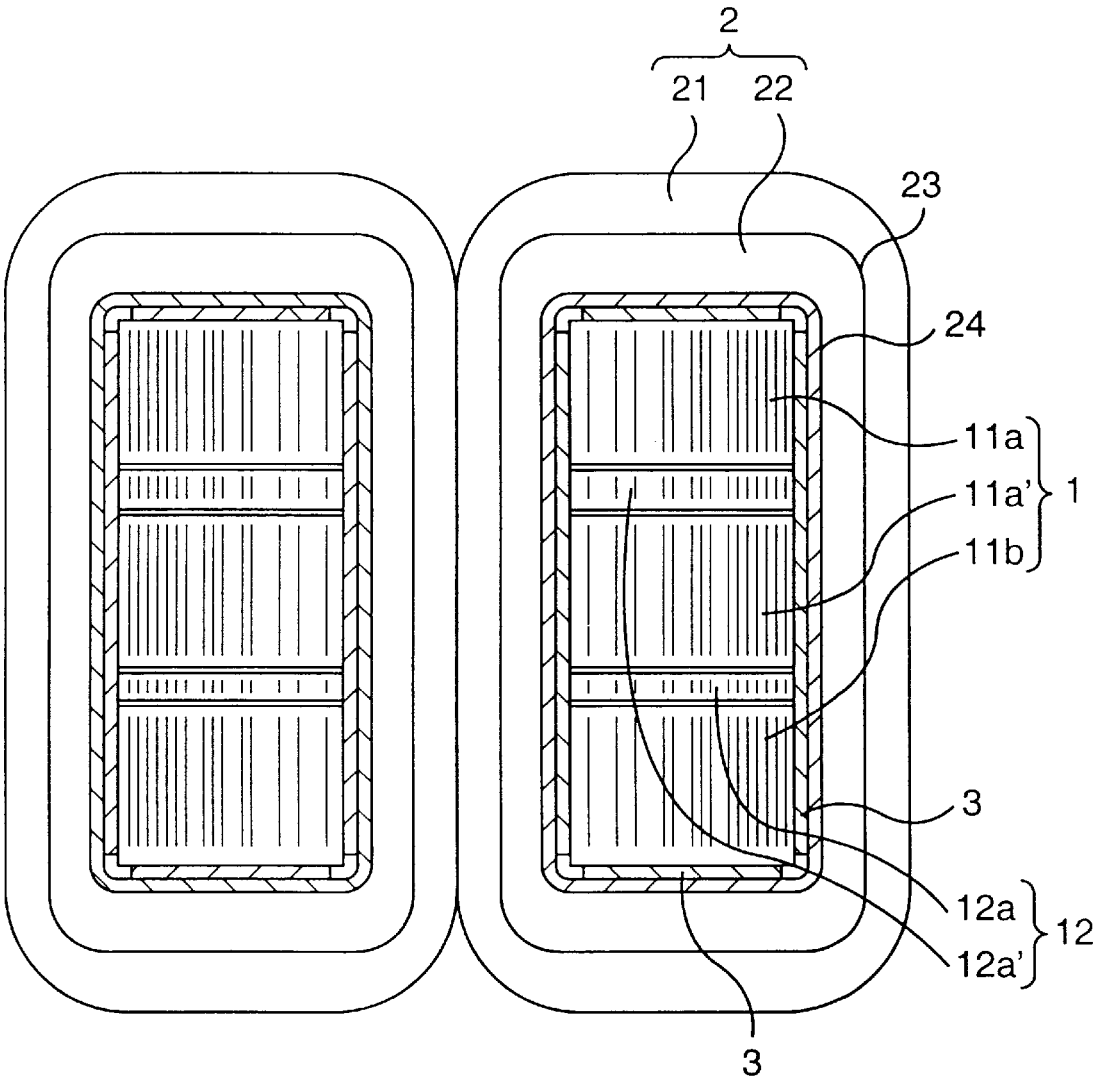
FIG. 2 is a horizontal cross-sectional view of the amorphous transformer according to a variation of the first embodiment of the present invention.

The principles of the above construction are also applicable to a three-phase amorphous wound laminated core transformer embodiment, as shown in FIG. 2. In this variation, the amorphous wound laminated core 1 has three amorphous cores and two silicon steel cores to obtain larger a cross-section that is larger than that of FIG. 1.

As shown in FIG. 2, three amorphous cores 11*a*, 11*a*, 11*b* and two silicon steel cores 12*a*, 12*a*' are juxtaposed edgewise. One of the silicon steel cores is disposed between the amorphous cores 11*a* and 11*a*', and the other is disposed between the amorphous cores 11*a*' and 11*b*, so as to reinforce the mid portions of the coil frame 24. Similarly, by employing (N) amorphous cores and (N−1) silicon steel cores disposed between the amorphous cores, an amorphous wound laminated core having a large cross-section can be obtained. (N being an integer not less than 2)

A second embodiment of an amorphous core transformer of the present invention is described with reference to FIGS. 3 through 6 and 13(*a*) or 15. In this embodiment, the transformer is also a single-phase transformer having an amorphous wound laminated core 1 and a pair of coils 2.

Figure 3:
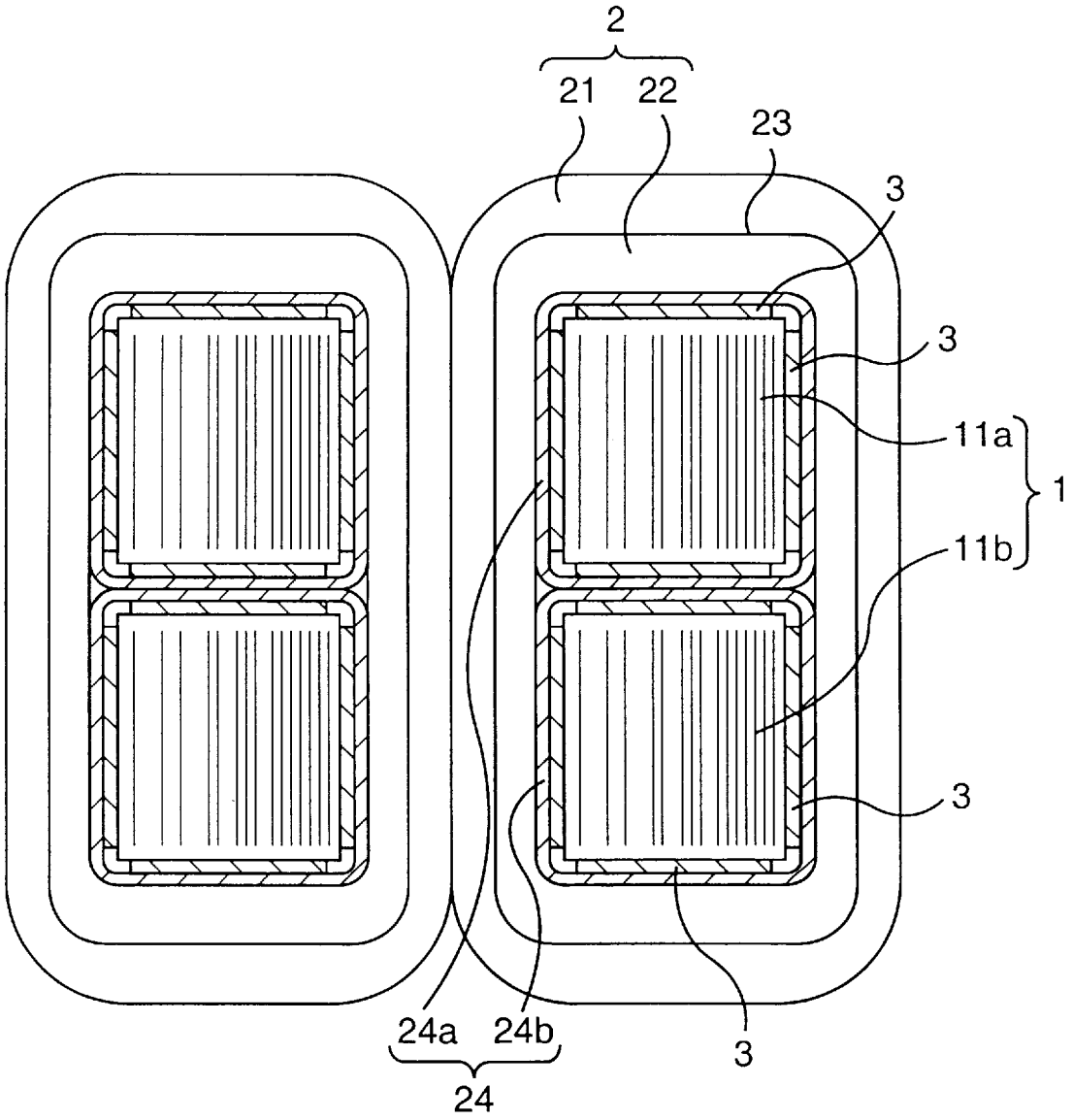
FIG. 3 is a horizontal cross-sectional view of an amorphous transformer according to the second embodiment of the present invention.

As shown in FIG. 3, the amorphous wound laminated core 1 has a first amorphous core 11*a* and a second amorphous core 11*b*. Each of the amorphous cores 11*a* and 11*b* includes a plurality of wound layers of amorphous sheets so as to form an amorphous wound laminated core, and these cores have the same construction as those disclosed in the first embodiment. In this embodiment, coil frame 24 includes two coil frames 24*a*, 24*b*, each disposed corresponding to amorphous cores 11*a*, 11*b* respectively. Further, although only one side of the transformer is explained in detail with accompanying reference numbers, the other side of the transformer has a similar construction.

Figure 4:
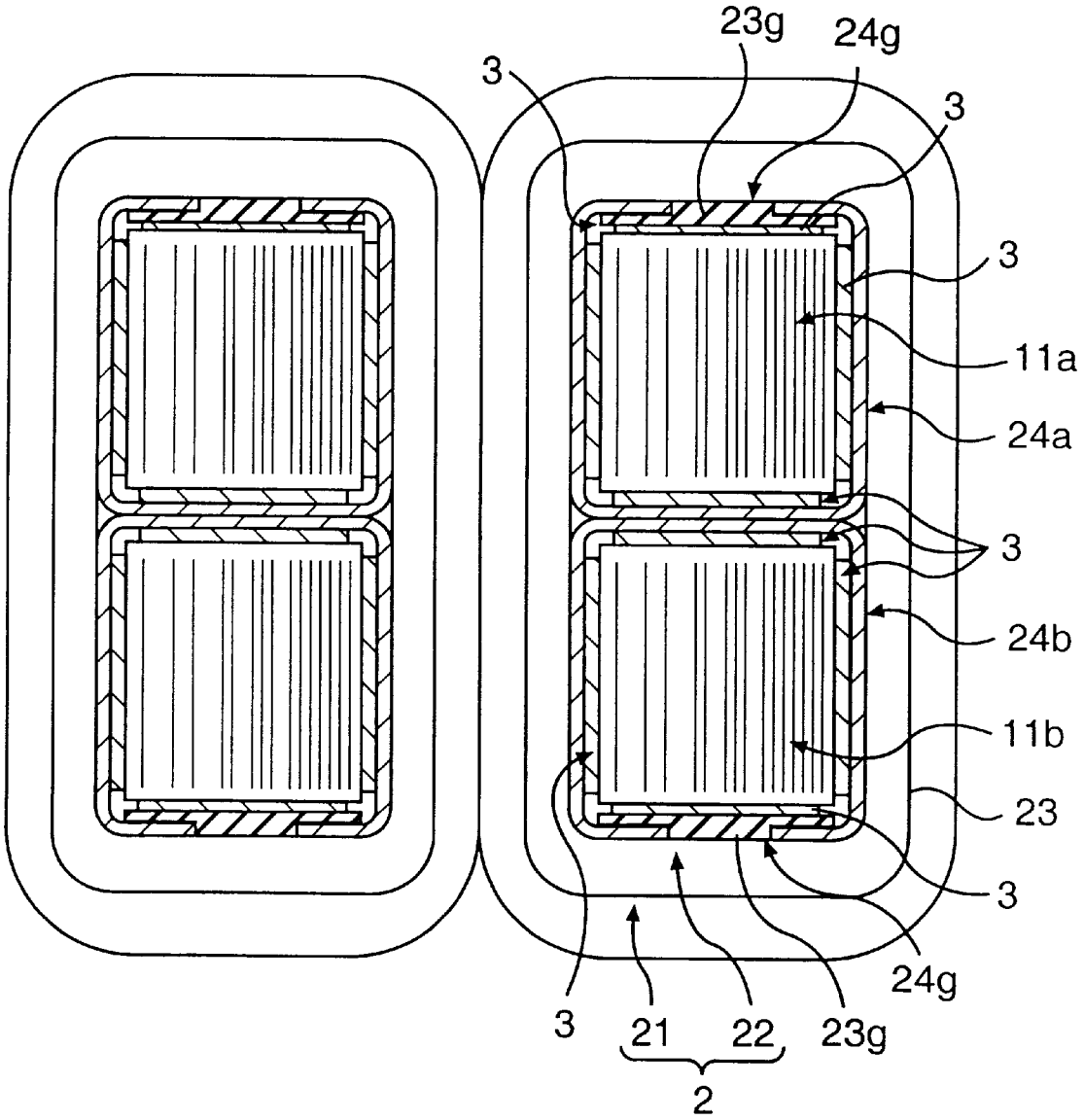
FIG. 4 is a horizontal cross-sectional view of an amorphous transformer according to a variation of the second embodiment of the present invention.
Figure 5:
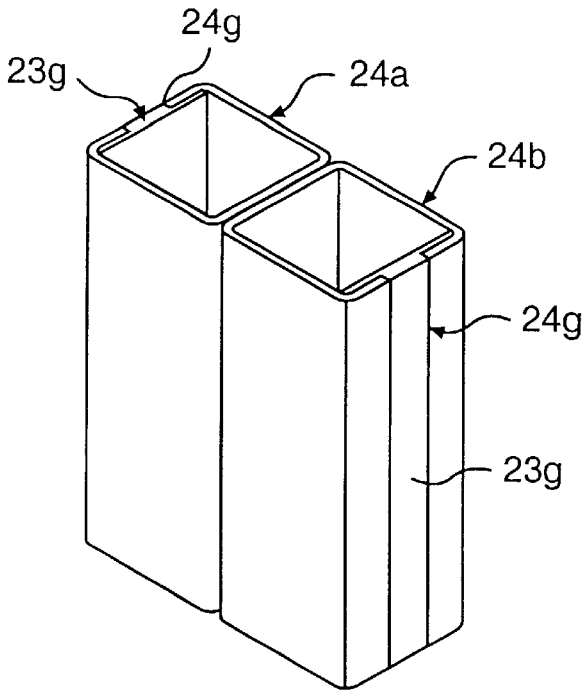
FIG. 5 is a perspective view of an arrangement of coil frames according to the second embodiment of the present invention.
Figure 6:
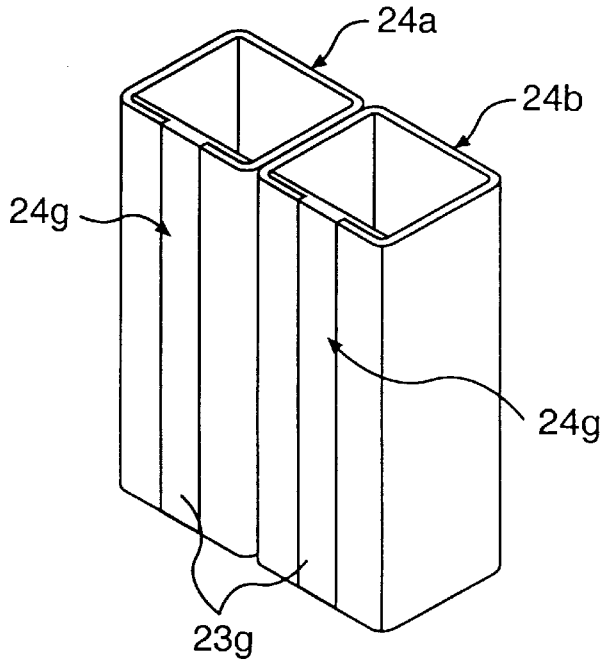
FIG. 6 is a perspective view of another arrangement of coil frames according to the second embodiment of the present invention.

Each of the coil frames 24*a*, 24*b* has a square or rectangular cross-section when they are made of an insulating material. As shown in FIGS. 4–6, when the coil frames 24*a*, 24*b* are made of low magnetic permeance steel plate having electrical conductivity, each has a C-shaped cross-section so as to form a slit 24*g* for preventing a one-turn-current or an eddy current from flowing inside. Both ends of the C-shaped cross-section frames are connected with electrical insulating member 23*g*. The coil frames 24*a*, 24*b* are juxtaposed and combined with each other, and the inner coil 22 and the outer coil 21 are wound around the outer surface of combined coil frames 24*a*, 24*b*.

The coil frames 24*a* and 24*b* are fixed together in a suitable way, for example, by using an adhesive, by binding with a tape or a sheet, by securing, by welding, or by fastening with screws or rivets. After winding inner coil 22 and the outer coil 21 on the surface of combined coil frames 24*a* and 24*b*, coils 11*a* and 11*b* are inserted into the coil frames 24*a* and 24*b* respectively with their joint portions 30*a* and 30*b* opened. Spacers 3 are inserted between the coil frame 24*a* and the amorphous core 11*a*, and between the coil frame 24*b* and the amorphous core 11*b*. Then, after the legs 11*e*, 11*f* are inserted into the coil frames 24*a*, 24*b* the joint portions 30*a*, 30*b* are closed again. In this embodiment, the juxtaposed portions of coil frames 24*a*, 24*b* function as a reinforcement member. When C-shaped coil frames are used, as shown in FIGS. 4–6, the electrical insulating member 23*g* is disposed in one of the three sides of each of the coil frames 24*a*, 24*b* except for the sides juxtaposed with each other. Reinforcement of the coil frames 24*a*, 24*b* is also available in this embodiment.

In order to obtain a larger core with a larger cross-section, each of the coil frames 24*a*, 24*b* is formed in a rectangular shape, and a plurality of amorphous cores are inserted in each coil frame. In this case, a juxtaposed portion of the coil frame, which is disposed perpendicular to the longer side of the coil and in parallel to the shorter side of the coil, also functions as reinforcement. For obtaining further reinforcement, the silicon steel core 12 is disposed between the amorphous cores within each one of the coil frames in the same way as disclosed in the first embodiment.

In the above embodiments, the inner winding 22 and the outer winding 21 are wound on the outer surface of the coil frame 24 (coil frames 24*a*, 24*b*). As one variation of this construction, the coil frame 24 (coil frames 24*a*, 24*b*) can be inserted in the opening of a coil window after winding the inner coil 22 and the outer coil 21 on a rectangular mandrel (not shown). As for the materials of the coil frames 24*a* and 24*b*, metal materials, such as stainless steel (SUS304) plate, are used for the C-shaped (in cross-section) coil frame, or insulating materials such as press-board, fiber-reinforced-plastics (FRP) or other insulating materials having similar strength characteristics. These press-board or FRP materials can also be used as the insulating member for the coil frames 24*a*, 24*b* having C-shaped cross-section. In addition, such metal materials as non-magnetic steel plate (e.g., stainless steel such as SUS 304) or vibration-suppressing steel plate (a complex of steel plates and a vibration-suppressing plastic plate) can also be used for the coil frames having C-shaped cross-section.

Figure 7:
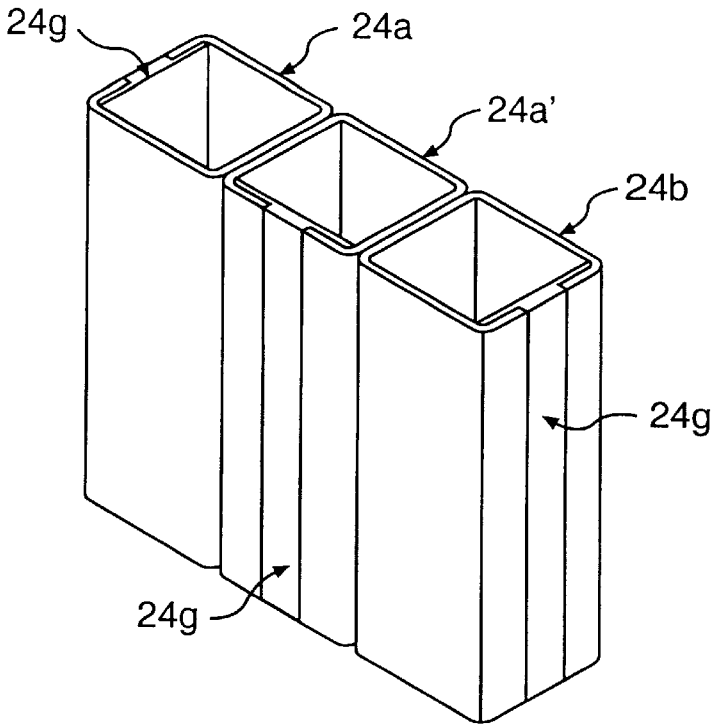
FIG. 7 is a perspective view of a further arrangement of coil frames according to the second embodiment of the present invention.
Figure 8:
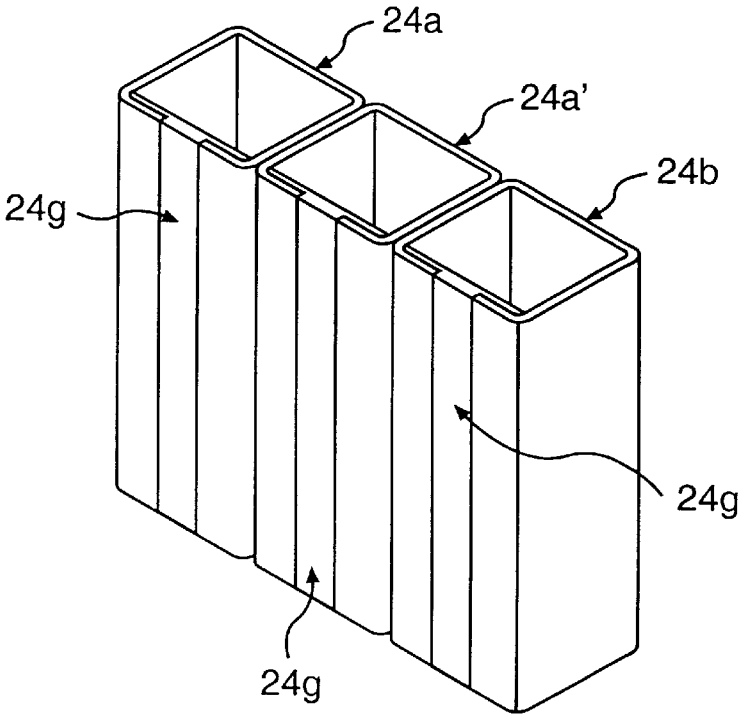
FIG. 8 is a perspective view of a further arrangement of coil frames according to the second embodiment of the present invention.

Variations of the second embodiment are described referring to FIGS. 7 and 8. When three cores 11*a*, 11*a*' and 11*b* (FIG. 2) are used in order to obtain wider cross-sectional area of the cores, three coil frames 24*a*, 24*a*' and 24*b* are employed respectively. Also in this case, the directions of the slits 24*g* are arranged to prevent the formation of a closed circuit for eddy-current even if the coil frames 24*a*, 24*a*', 24*b* are combined together, i.e., the coil frames are combined according to a rule that a side having a gap must not be combined with a side without the gap. Examples of the preferred combinations of the directions of the slits are disclosed in FIGS. 7 and 8. Not all of the possible combinations are restricted to the disclosed embodiments of FIGS. 7 and 8, however.

A third embodiment of the present invention is described with reference to FIGS. 9 through 14 and FIGS. 17 and 18. In this embodiment, the present invention is applied to a three-phase amorphous wound laminated core transformer. As disclosed in FIGS. 9 and 10, four amorphous wound laminated cores 1A, 1B, 1C, 1D and three coils 2A, 2B, 2C are combined so as to provide a three-phase five-leg amorphous wound laminated core transformer. The transformer is a shell type transformer with the legs of the outer cores 1A, 1D disposed outside of the coils 2A, 2C.

Figure 9:
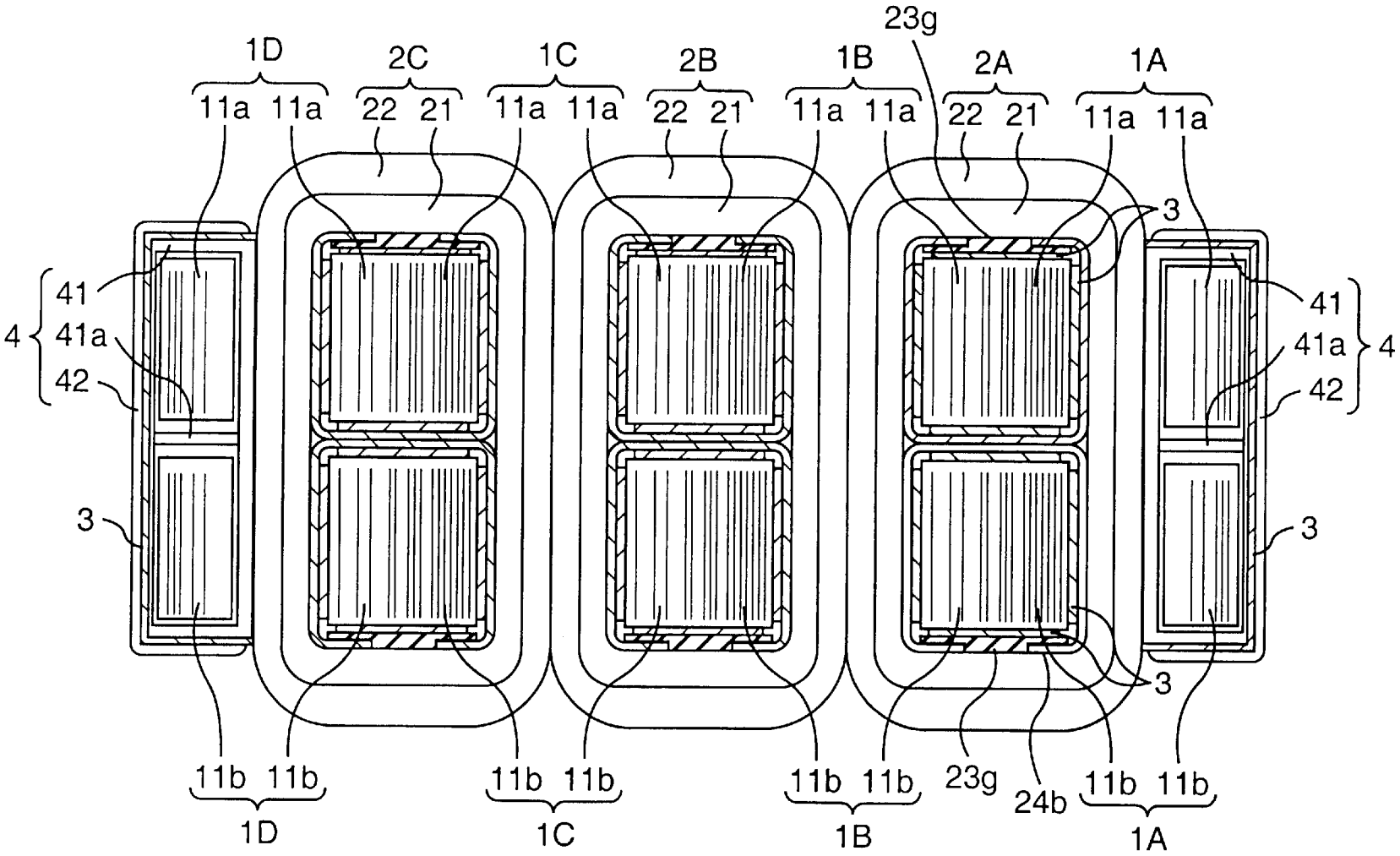
FIG. 9 is a horizontal cross-sectional view of an amorphous transformer according to the third embodiment of the present invention.

As shown in FIG. 9, each of the coils 2A, 2B, 2C also includes an inner coil 22 and an outer coil 21, and each of the amorphous wound laminated cores 1A, 1B, 1C, 1D includes a pair of amorphous cores 11*a*, 11*b* juxtaposed edgewise. In this embodiment, each of the amorphous cores 11*a* and 11*b* is inserted into the coil frames 24*a* and 24*b* respectively. The juxtaposed portion of the coil frames 24*a*, 24*b* functions as a reinforcement member in a similar manner to that disclosed in the second embodiment.

The difference between the third embodiment and that of the second embodiment is that the legs of the adjacent coils are inserted into a coil frame so as to form a lamination in the radial direction of the wound cores. Another difference from the second embodiment is that each of the outside portions of the outermost cores 1A, 1D are covered with a reinforcement frame 4.

Figure 10:
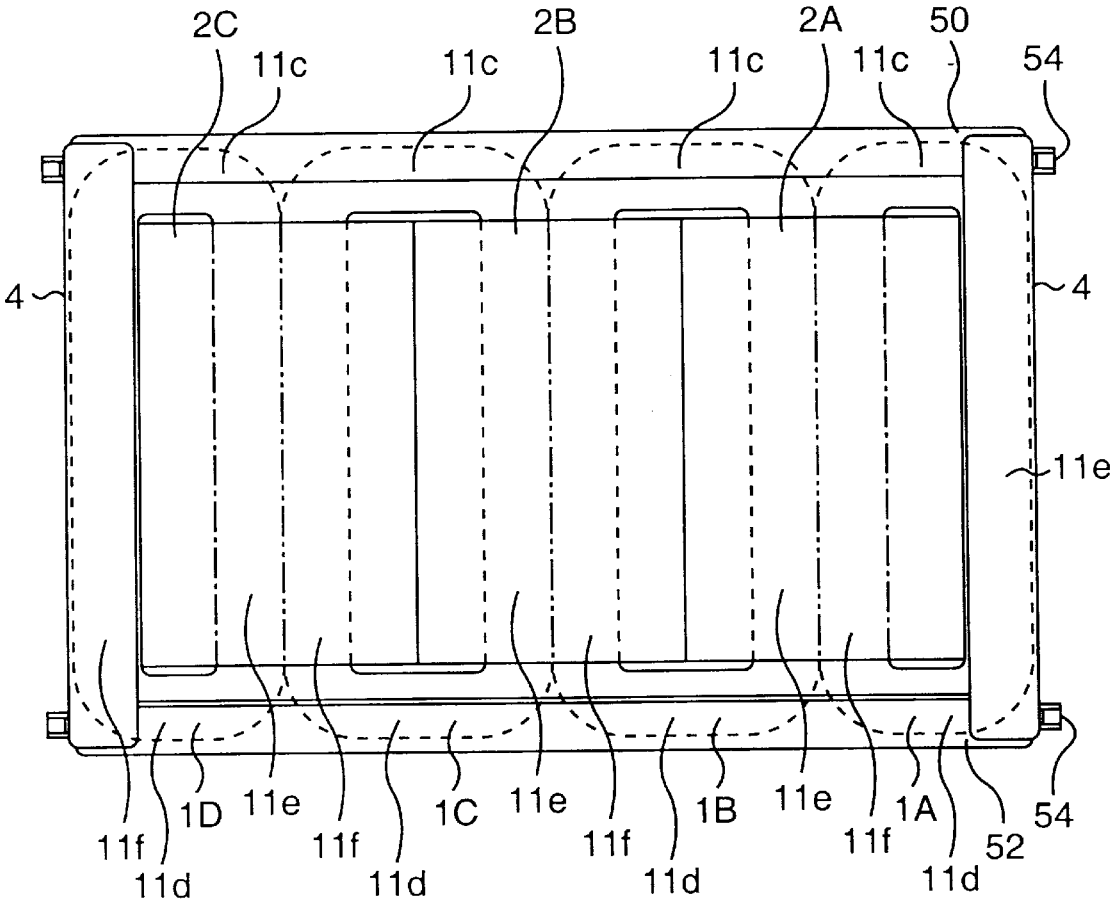
FIG. 10 is a plan view of the amorphous transformer of the third embodiment of the present invention.
Figure 11:
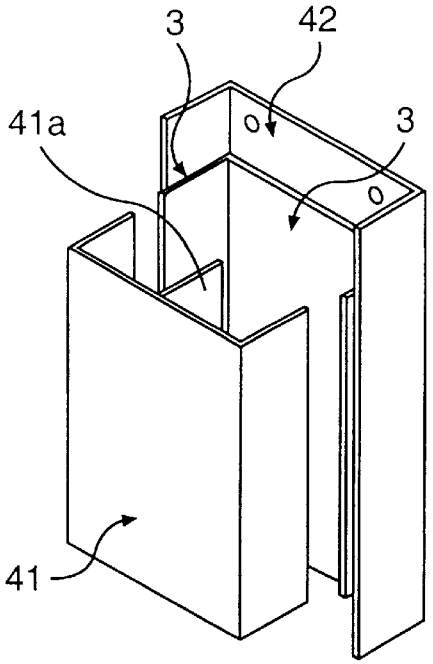
FIG. 11 is a perspective view of reinforcement frames used in the third embodiment of the present invention.

The reinforcement frame 4 is made of steel plate and has an inner frame 41 disposed inside the outermost core and an outer frame 42 disposed outside the outermost core so as to enclose the outside portion of the outermost core as disclosed in FIG. 11. The inner frame 41 of the reinforcement frame 4 has an E-shaped cross-section as disclosed in FIG. 11, and a central projection portion 41*a* functions as a reinforcement member against an outward force generated by the outer coil 21. The upper end and the lower end of the outer frame 42 are fixed to an upper frame 50 and a lower frame 52 with bolts 54, as schematically shown in FIG. 10. Thus, the reinforcement frame 4 can prevent the outermost core from being pressed and deformed by an outward deflection of the outer coil 21. This construction is effective to prevent the outermost core from being deformed by the outward deflection of the outer coil even in the case of a shell-type single-phase transformer.

Further, in this embodiment, a cover member is employed for enclosing the surface of the amorphous core. As is known, amorphous metal is very brittle, especially after annealing, the laminated amorphous sheets in the wound laminated core sometimes break into small fragments by shock or stress applied to the core. When the amorphous core is soaked or submerged in coolant oil, these fragments are easily carried away by convection flow of the coolant oil, and reach an electrically live portion, which sometimes causes deterioration of the insulation at the terminal portion of the coils or causes a short circuit in the layers of the inner coil 22 or outer coil 21.

Figure 12:
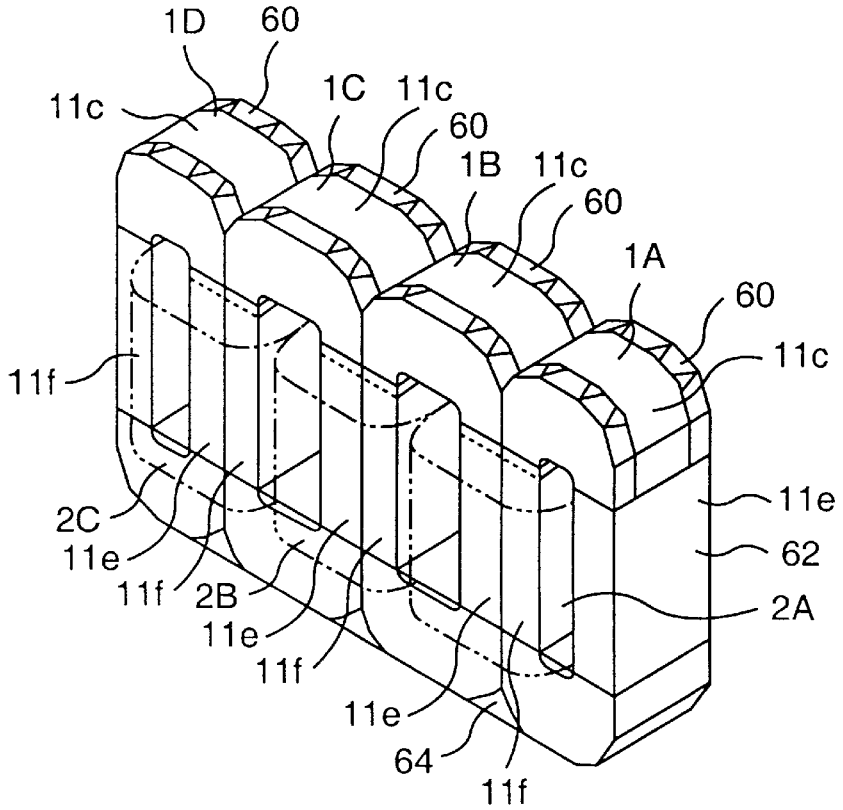
FIG. 12 is a perspective view of amorphous cores with cover members used in the third embodiment of the present invention.

In order to prevent the fragments from reaching the electrically live portion, the cover member encloses one of the yoke portions 11*c*, 11*d* and two leg portions 11*e*, 11*f* of the amorphous core 11*a*, 11*b*. In this embodiment, as shown in FIG. 12, the cover member is made of an insulating material and includes a portion 60 (hereinafter cover member 60) covering the yoke portions 11*c* and a pair of portions 62 (hereinafter cover member 62) covering both of the leg portions 11*e*, 11*f*. As disclosed in FIG. 13(*a*), yoke portion 11*c* is covered by the cover member 60 and the other yoke portion 11*d*, including the joint portions 30*a*, 30*b*, is exposed or not covered by the cover member 60, 62. As for the material of the cover member 60, 62, a press-board sheet are used generally.

In this case, as shown in FIG. 12, an edge of the press-board sheet of the cover member 60 is notched and folded along an outer edge of the yoke portion 11*c*. Further, a press-board sheet of the cover member 62 is folded so as to enclose the outer surfaces of the leg portions 11*e*, 11*f*. At this stage, the amorphous core is formed in a U-shape with the joint portions 30*a*, 30*b* opened as shown in FIG. 13(*a*). The manufacturing steps of covering the yoke portions 11*c*, and the leg portions 11*e*, 11*f* with the cover members 60, 62 are the same as those disclosed in Japanese patent laid-open publication no. (Hei) 8-31667.

Figure 14:
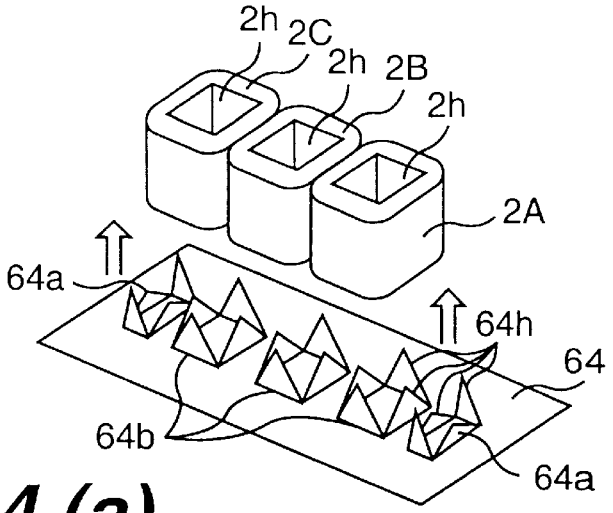
FIGS. 14(*a*)–14(*g*) are diagrams showing the process of assembling the cores and the coils according to the third embodiment of the present invention.
Figure 14:
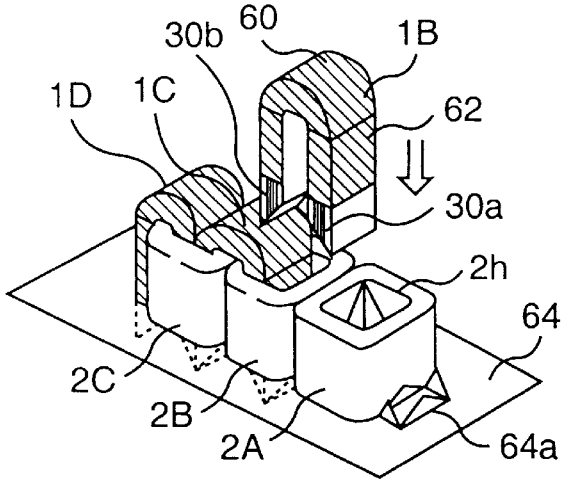
Figure 14:
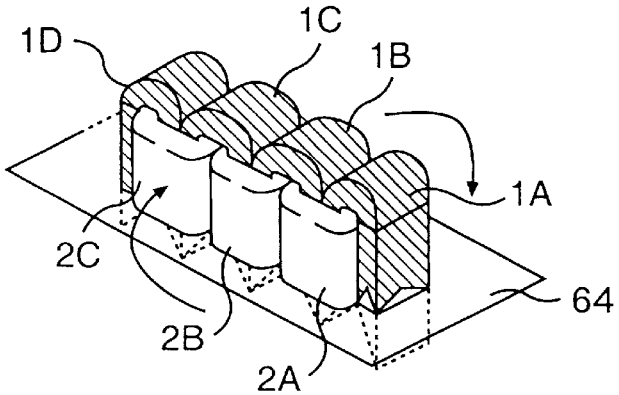
Figure 14:
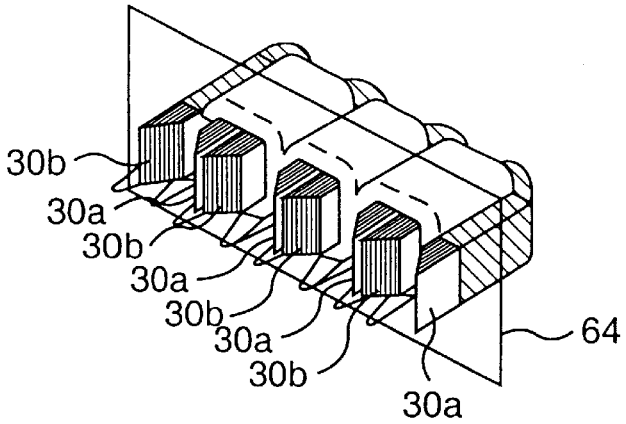
Figure 14:
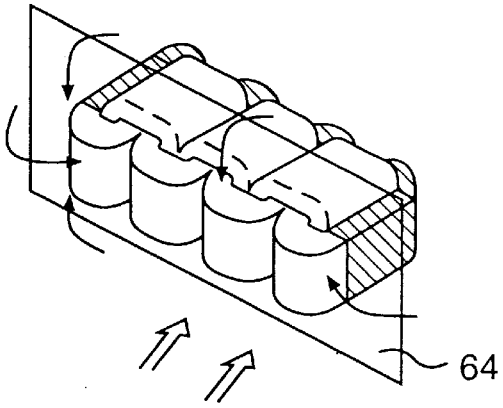
Figure 14:
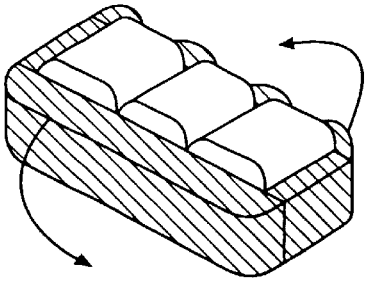
Figure 14:
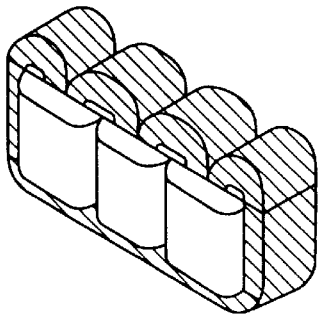
Figure 15:
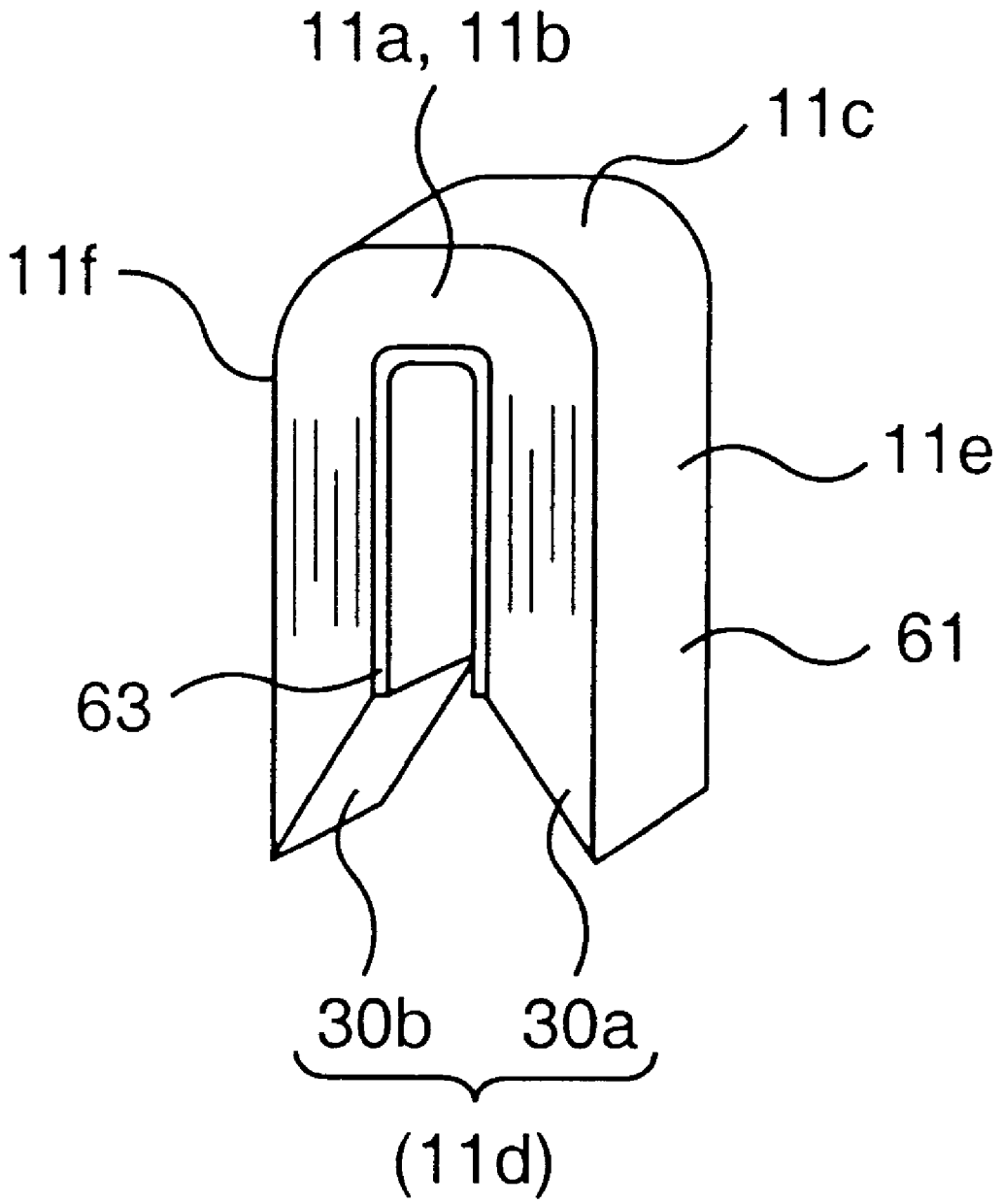
FIG. 15 is a perspective view of another amorphous core with a joint portion opened according to the fourth embodiment of the present invention.

FIGS. 14(*a*)–14(*g*) show how the amorphous cores are combined with the coils. In particular, FIG. 14(*a*) illustrates the step wherein the coils 2A, 2B and 2C are disposed and fixed on a wrapping member 64. The wrapping member 64 has five holes including outermost holes 64*a* and inner spaced holes 64*b*, each respectively receiving the corresponding legs of the cores, which are inserted therein. The three inner holes 64*b* are formed substantially at the same pitch as that of opening windows 2*h* of the coils 2A, 2B, 2C as shown in FIGS. 17(*a*) or 18(*a*). The outer holes 64*a* are formed corresponding to the outermost leg 11*e* of the outermost core 1A and to the outermost leg 11*f* of the outermost core 1D, respectively. The area of the opening of hole 64*b* is wider than that of hole 64*a* by approximately twice as much, since two legs are inserted in each of the holes 64*b* while one leg is inserted in each of the holes 64*a*. The wrapping member 64*a* shown in FIG. 17(*a*) has folded portions 64*h* within every hole 64*a*, 64*b*, and the folded portion 64*h* is folded inside along the inner surface of the opening 2*h* of each coil 2A, 2B, 2C. The folded portion 64*h* has a slit portion 64*s* so as to escape the reinforcement member. As shown in particular by FIG. 17(*b*), which is an enlarged view of the encircled corner portion 17*b* of a hole 64*b*, the wrapping member 64 is fixed to each coil by adhesive tape 67, 68. By this arrangement, which is adopted for each corner of holes 64*b* and also for holes 64*a*, but not specifically shown, the tape 67 fixes each corner of the holes 64*a* and 64*b*. Further, as shown in this figure, the tape 68 is fixed so as to seal a gap between the edge of the folded portion 64*h* and the inner surface of the coil opening 2*h*.

Next, cores 1A, 1B, 1C and 1D are inserted into the holes 64*a* and 64*b* through the opening 2*h* of the coils 2A, 2B and 2C, as shown in FIG. 14(*b*). FIG. 14(*c*) shows the result achieved upon the completion of the step shown in FIG. 14(*b*). In the next step, the cores 1A, 1B, 1C, 1D and the coils 2A, 2B, 2C are turned so as to be laid horizontally as shown in FIG. 14(*d*). With the cores so arranged, the joint portions 30*a* and 30*b* of each core are closed, as shown in FIG. 14(*e*). Then, the wrapping member 64 is folded inside so as to wrap the joint portions of the cores 1A, 1B, 1C, 1D as a whole as shown in FIG. 14(*f*). Since the wrapping member 64 wraps the cores as a whole, the manufacturing process can be simplified and manufacturing time can be reduced. After the wrapping is over, the cores and the coils are disposed vertically as shown in FIG. 14(*g*). After this step, upper frame 50 and lower frame 52 are attached; and the reinforcement frames 4 are fixed to the upper frame 50 and lower frame 52 as shown in FIG. 10.

FIGS. 18(*a*) and 18(*b*) show a variation of the wrapping member 64. In this variation, folded portions 64*h* are disposed only in holes 64*a*, similarly to the FIG. 17(*a*) embodiment. Just square or rectangular holes are formed for holes 64*b*. As shown by the encircled portion 18*b*, in an enlarged partial view in FIG. 18(*b*), the wrapping member 64 is fixed to the coil by adhesive tape 67 and a gap between the edge of the holes 64 and the inside of the coils 2A, 2B, 2C is sealed by adhesive tape 68 in the similar manner to that disclosed in FIG. 17(*b*).

The fourth embodiment of the present invention is described referring to FIGS. 7, 8, 15–17, 19 and 20. In this embodiment, wrapping members 64 are disposed on both sides of the coils and wrap both yokes 11*c* and 11*d* of each coil as a whole.

Figure 16:
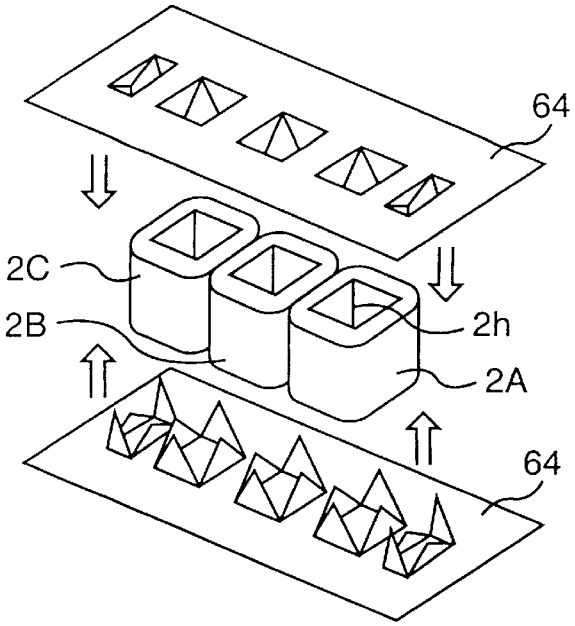
FIGS. 16(*a*)–16(*g*) are diagrams showing the process of assembling the cores and the coils according to the fourth embodiment of the present invention.
Figure 16:
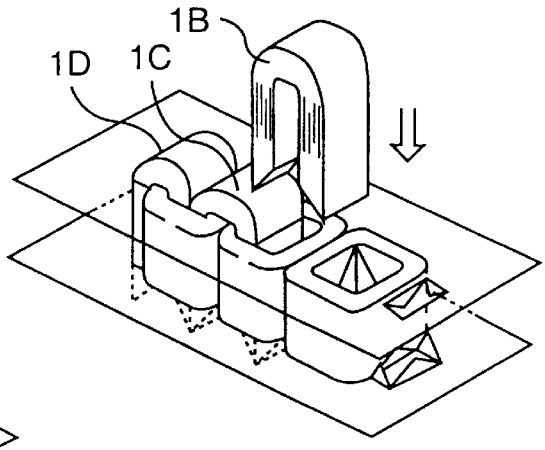
Figure 16:
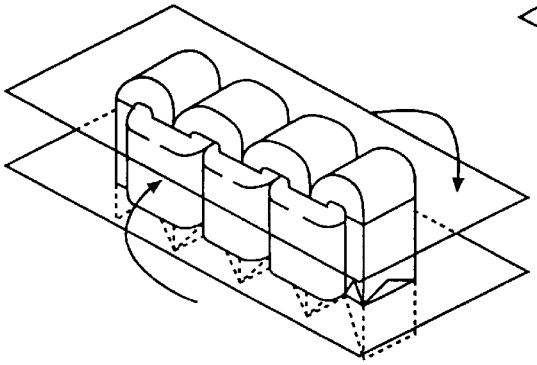
Figure 16:
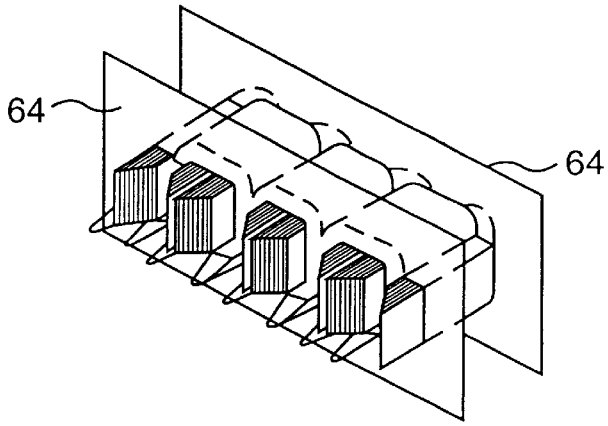
Figure 16:
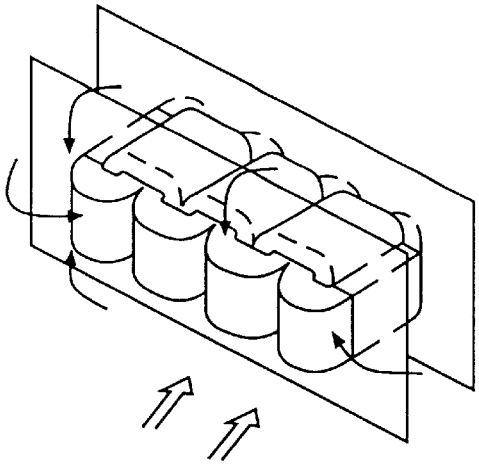
Figure 16:
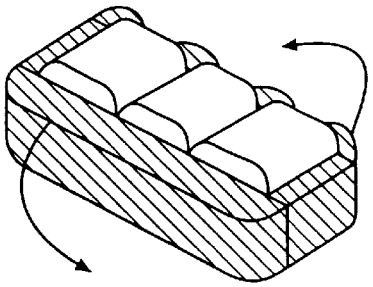
Figure 16:
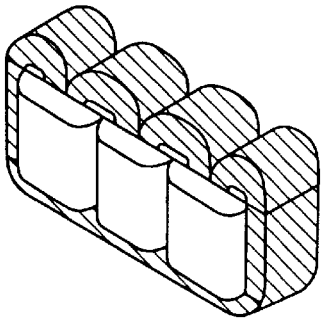

FIGS. 16(*a*)–16(*g*) show how the amorphous cores are combined with the coils according to the fourth embodiment in several steps that are similar to those shown in FIGS. 14(*a*)–14(*g*). In particular, FIG. 16(*a*) illustrates a step wherein the coils 2A, 2B and 2C are wrapped from above and below with wrapping members 64. The wrapping members 64 are the same as the one used in the third embodiment, and a detailed description thereof is accordingly unnecessary. The cores 1A, 1B, 1C and 1D are inserted into the holes of the upper and lower wrapper members 64, as shown in FIG. 16(*b*) to achieve the result shown in FIG. 16(*c*). In the next step, the cores 1A, 1B, 1C, 1D and the coils 2A, 2B, 2C are turned so as to be laid horizontally as shown in FIG. 16(*d*). With the cores so arranged, the joint portions of each core are closed, as shown in FIG. 16(*e*). Then, the wrapping members 64 are folded inside so as to wrap the joint portions of the cores 1A, 1B, 1C, 1D as a whole as shown in FIG. 16(*f*). After the wrapping is over, the cores and the coils are disposed vertically as shown in FIG. 16(*g*).

Figure 19:
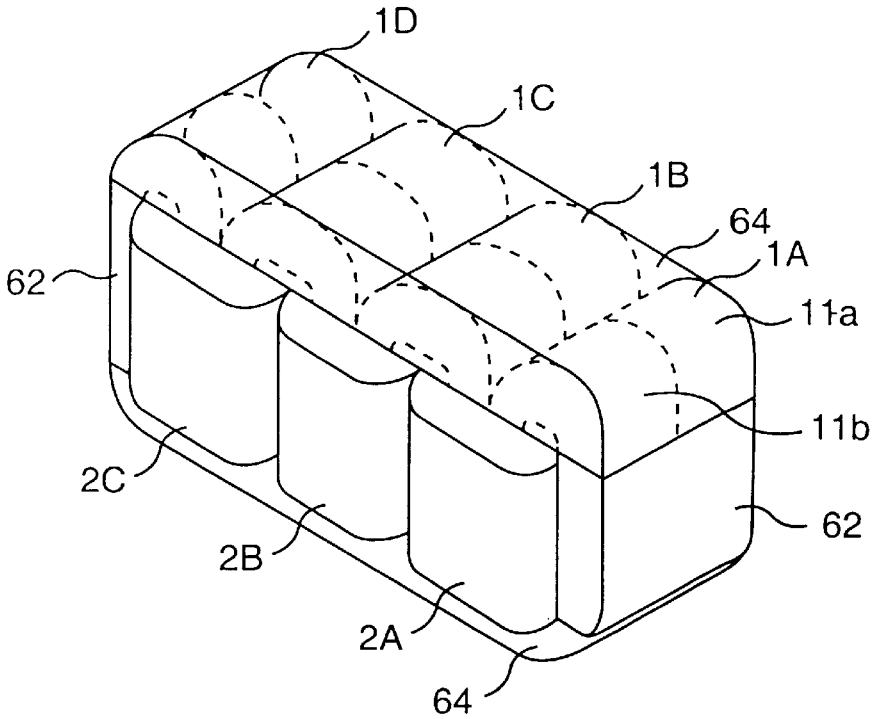
FIG. 19 is a perspective view of an assembly of the core, the coil and the cover member according to the fourth embodiment of the present invention.
Figure 20:
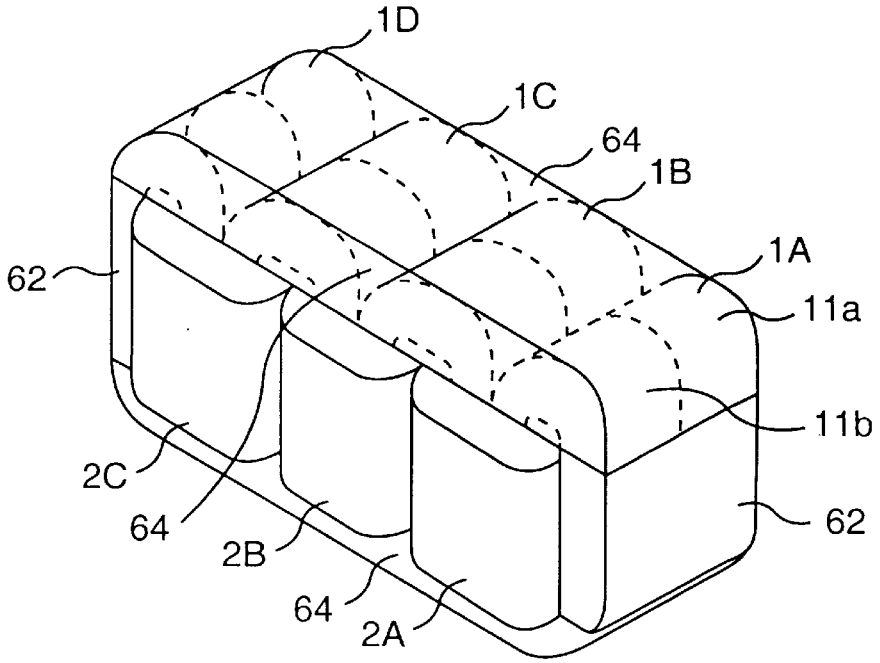
FIG. 20 is a perspective view of a variation of the assembly of the core, the coil and the cover member according to the fourth embodiment of the present invention.
Figure 21:
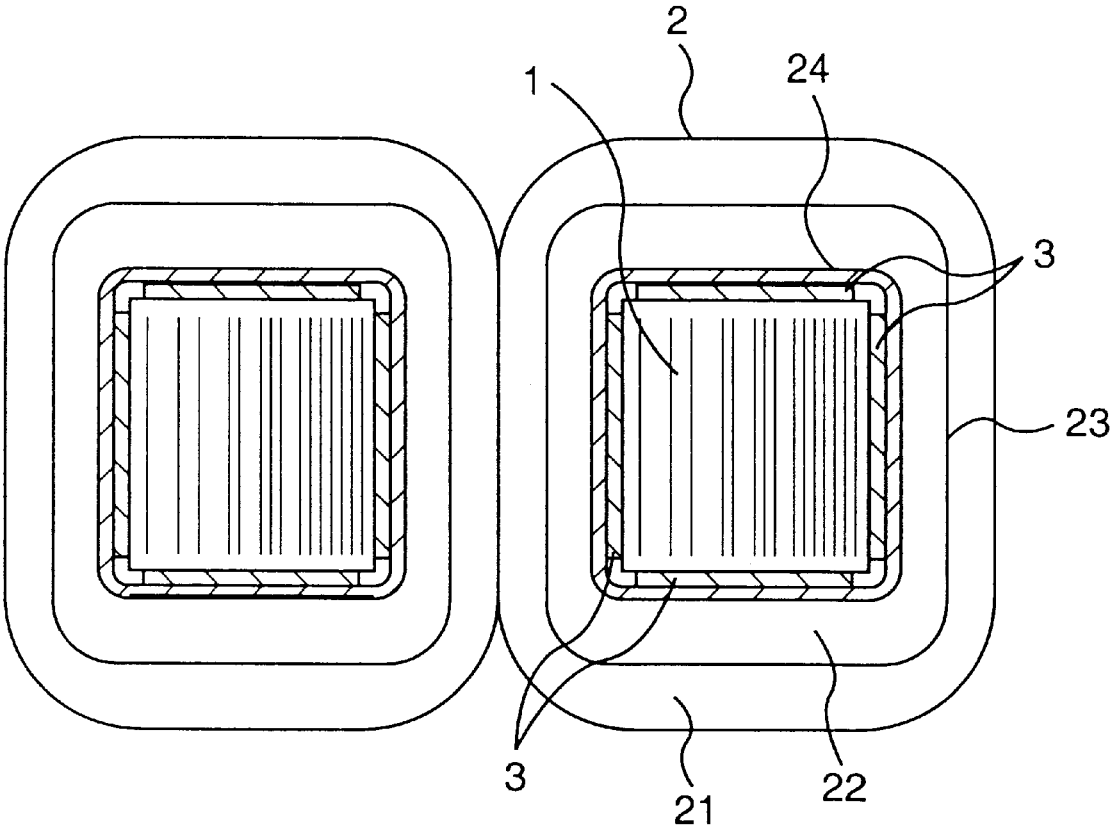
FIG. 21 (PRIOR ART)
FIG. 21 is a horizontal cross-sectional view of an amorphous transformer of the prior art.
Figure 22:
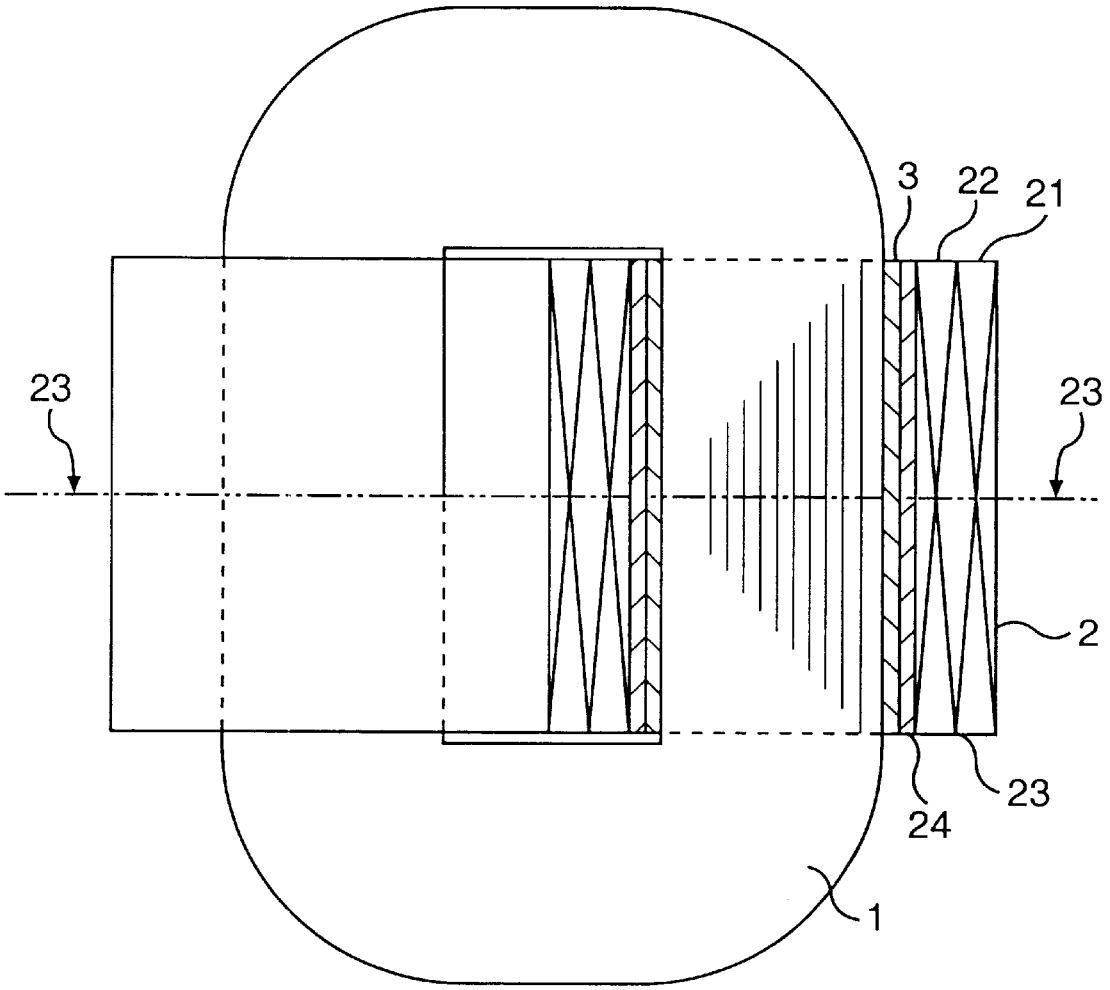
FIG. 22 (PRIOR ART)
FIG. 22 is an elevational cross-sectional view of the amorphous transformer of the prior art shown in FIG. 21.
Figure 23:
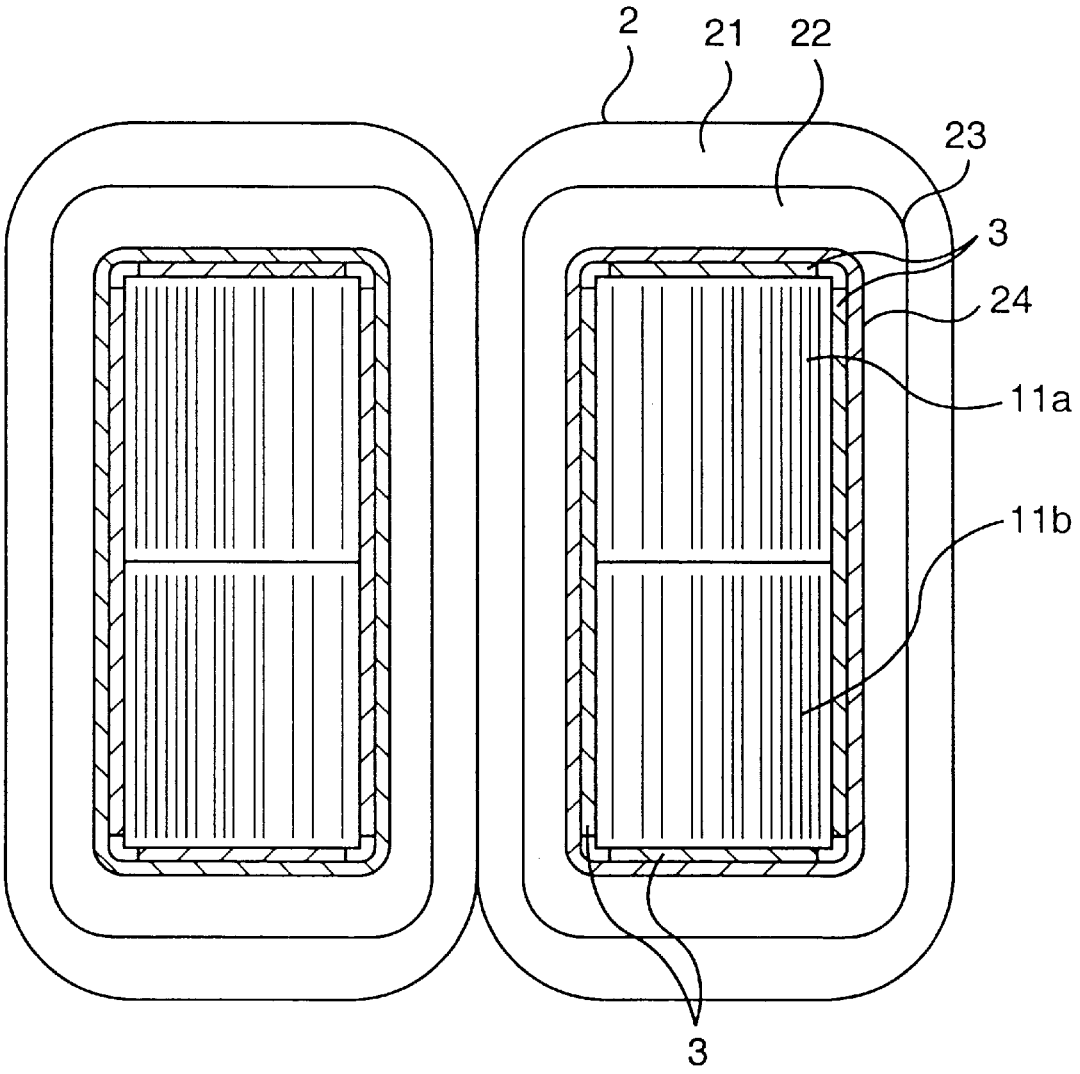
FIG. 23 (PRIOR ART)
FIG. 23 is a horizontal cross-sectional view of the amorphous transformer of the prior art.

The final shape of the core-coil assembly according to this embodiment is shown in FIG. 19. The wrapping member may be divided in two as disclosed in FIG. 20. In this case cores 11*a*, 11*b* are not necessarily enclosed completely by cover means. As disclosed in FIG. 15, a core with inner cover 63 and outer cover 61 is enough in this embodiment, and this arrangement can be disposed for the amorphous cores and the silicon steel core. Otherwise, the construction is the same as that of the third embodiment. Further simplification of manufacturing is possible in this embodiment.

While preferred embodiments have been set forth with specific details, further embodiments, modifications and variations are contemplated according to the broader aspects of the present invention, all as determined by the spirit and scope of the following claims.

What is claimed is:

1. An amorphous transformer, comprising:

a first amorphous core including a plurality of wound layers of amorphous sheets;

a second amorphous core including a plurality of wound layers of amorphous sheets and juxtaposed to said first amorphous core;

a reinforcement member disposed between said first amorphous core and said second amorphous core;

a coil including a plurality of layers of electric conductors and having an opening for inserting said first amorphous core and said second amorphous core; and a frame member disposed along an inside of said opening for winding said conductors thereon;

wherein said reinforcement member is a silica-steel core having a plurality of wound layers of silica-steel metal sheets, said silica-steel core having a thickness not less than that of said first amorphous core and said second amorphous core, and said silica-steel core, said first amorphous core and said second amorphous core are disposed side by side in an axial direction thereof to reinforce said first amorphous core and said second amorphous core against being deformed inward by electromagnetic force from said coil, and said frame member and said reinforcement member prevent formation of an electrical closed-loop.

2. An amorphous transformer according to claim 1, wherein said reinforcement member is a first reinforcement member, and further including a second silica steel core reinforcement member and a third amorphous core including a plurality of wound layers of amorphous sheets juxtaposed to one of said first and said second amorphous cores, wherein said second reinforcement member is disposed between said one of said first amorphous core and said second amorphous core and said third amorphous core.

3. An amorphous transformer according to claim 2, wherein each of said first and second reinforcement members is a silica-steel core having a plurality of wound layers of silica-steel metal sheets, each said silica-steel core having a thickness not less than that of said first, second and third amorphous cores.

4. An amorphous transformer according to claim 1, wherein said reinforcement member is a silica-steel core having a plurality of wound layers of silica-steel metal sheets, and wherein said first and said second amorphous cores are two of (N) amorphous cores and said silica-steel core is one of (N−1) silica steel cores, wherein said amorphous transformer includes (N) amorphous cores and (N−1) silica-steel cores disposed between the (N) amorphous cores, and wherein N is an integer not less than 2.

5. An amorphous transformer according to claim 1, wherein said first amorphous core has a pair of yoke portions and a first joint portion for opening said first amorphous core at one of said yoke portions, said second amorphous core has a pair of yoke portions and a second joint portion for opening said second amorphous core at one of said yoke portions and further comprising a cover member for covering a surface of said first amorphous core and said second amorphous core except said first joint portion and said second joint portion, and a wrapping member having an opening corresponding to said opening of said coil for wrapping said yoke portion of said first amorphous core and said second amorphous core.

6. An amorphous core transformer, comprising:

a first amorphous core including a plurality of wound layers of amorphous sheets;

a second amorphous core including a plurality of wound layers of amorphous sheets, said first and second amorphous cores being disposed side by side;

said first and second amorphous cores having opposed yoke portions and legs between said yoke portions; and a reinforced coil frame member including a plurality of coil frames made of steel plate, said coil frames having a C-shaped cross-section so as to form a slit for preventing an eddy current from flowing, both ends of said C-shaped cross-section frames are connected with an electrical insulating member; and a plurality of layers of electric conductors wound around said coil frame member, wherein said coil frames are juxtaposed and combined with each other, the legs of each of said first and second amorphous cores are respectively surrounded by adjacent ones of said coil frame members with said electric conductors wound around said coil frame members, a juxtaposed portion of said coil frames functions as said reinforcement member, said reinforcement member reinforces said first amorphous core and said second amorphous core against being deformed inward by electromagnetic force from said coil, and said frame member and said reinforcement member prevents formation of an electrical closed loop.

7. An amorphous transformer according to claim 6, wherein one of said yoke portions of each of said amorphous cores has a joint portion for forming an opening by which each of said legs is received in a corresponding one of said adjacent coil frame members.

8. An amorphous transformer according to claim 6, wherein said coil frame members are disposed adjacent one another without said electrically insulating portion of one said coil frame member contacting said electrically conducting portions of said adjacent coil frame member.

9. An amorphous core transformer, comprising:

at least two amorphous cores including a plurality of wound layers of amorphous sheets disposed side by side;

each of said amorphous cores having opposed yoke portions and legs between said yoke portions; and a reinforced coil frame member including a reinforcement member disposed between said amorphous cores; and a coil wound around said coil frame member including a plurality of layers of electric conductors and having an opening for inserting said amorphous cores, wherein said reinforcement member is a silica-steel core having a plurality of wound layers of silica-steel metal sheets, said silica-steel core has a thickness not less than that of said first amorphous core and said second amorphous core, said silica-steel core reinforces said amorphous cores against being deformed inward by electromagnetic force from said coil, and said reinforced coil frame member and said reinforcement member prevents formation of an electrical closed loop.

10. An amorphous transformer, comprising;

a first amorphous core including a plurality of wound layers of amorphous sheets;

a second amorphous core including a plurality of wound layers of amorphous sheets and juxtaposed to said first amorphous core;

a reinforcement member disposed between said first amorphous core and said second amorphous core;

a coil including a plurality of layers of electric conductors and having an opening for inserting said first amorphous core and said second amorphous core; and a frame member disposed along an inside of said opening for winding said conductors thereon;

wherein said frame member includes two coil frame parts, each of said coil frame parts is adapted to enclose a corresponding one of said first amorphous core and said second amorphous core, a juxtaposed portion of said coil frame parts functions as said reinforcement member, said reinforcement member reinforces said first amorphous core and said second amorphous core against being deformed inward by electromagnetic force from said coil, and said frame member and said reinforcement member prevent formation of an electrical closed loop.

11. An amorphous core according to claim 10, wherein said first amorphous core has a pair of yoke portions and a first joint portion for opening said first amorphous core at one of said yoke portions, said second amorphous core has a pair of yoke portions and a second joint portion for opening said second amorphous core at one of said yoke portions, and further comprising a cover member for covering a surface of said first amorphous core and said second amorphous core except said first joint portion and said second joint portion, and a wrapping member having an opening corresponding to said opening of said coil for wrapping said yoke portion of said first amorphous core and said second amorphous core.

* * * * *